US007938694B2

(12) United States Patent
Hiramitsu et al.

(10) Patent No.: US 7,938,694 B2
(45) Date of Patent: May 10, 2011

(54) CONNECTOR TERMINAL AND CONNECTOR WITH THE CONNECTOR TERMINAL

(75) Inventors: Hiroomi Hiramitsu, Yokkaichi (JP); Hosei Mizuno, Yokkaichi (JP); Kouichi Matsumoto, Yokkaichi (JP); Hiroki Hirai, Yokkaichi (JP); Akira Ito, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 10 days.

(21) Appl. No.: 12/449,722

(22) PCT Filed: Mar. 26, 2008

(86) PCT No.: PCT/JP2008/055703

§ 371 (c)(1),
(2), (4) Date: Aug. 24, 2009

(87) PCT Pub. No.: WO2008/120632

PCT Pub. Date: Oct. 9, 2008

(65) Prior Publication Data

US 2010/0029142 A1 Feb. 4, 2010

(30) Foreign Application Priority Data

Mar. 29, 2007 (JP) ..... 2007-087551

(51) Int. Cl.
*H01R 11/22* (2006.01)

(52) U.S. Cl. ..... 439/851; 439/854

(58) Field of Classification Search ..... 439/851, 439/854, 855, 881

See application file for complete search history.

(56) References Cited

U.S. PATENT DOCUMENTS

| | | | | |
|---|---|---|---|---|
| 2,266,530 | A | 12/1941 | Andren | |
| 2,563,775 | A | 8/1951 | Del Camp | |
| 4,917,635 | A | 4/1990 | Landries et al. | |
| 5,160,282 | A * | 11/1992 | Swaffield et al. | 439/721 |
| 5,186,658 | A * | 2/1993 | Kikuchi et al. | 439/595 |
| 6,280,230 | B1 | 8/2001 | Takase et al. | |

FOREIGN PATENT DOCUMENTS

| | | |
|---|---|---|
| DE | 697 16 524 T2 | 8/2003 |
| FR | 2 842 028 A1 | 1/2004 |
| JP | U-56-175973 | 12/1981 |
| JP | U-57-130974 | 8/1982 |
| JP | U-2-76482 | 6/1990 |
| JP | A-10-189085 | 7/1998 |
| JP | A-10-223284 | 8/1998 |
| JP | A-2006-228759 | 8/2006 |

* cited by examiner

OTHER PUBLICATIONS

Office Action issued in German Patent Application No. 11 2008 000 656.3-34; mailed Sep. 29, 2010; with English-language translation.

*Primary Examiner* — Ross N Gushi
(74) *Attorney, Agent, or Firm* — Oliff & Berridge, PLC

(57) ABSTRACT

An object of the present invention is to provide a connector terminal which can be easily fitted to or separated from a partner terminal (partner connector) even if the space for fitting operation is limited in the fitting direction. The connector terminal has a terminal inserting portion to which the partner terminal is inserted, and a coupling portion intercoupling and electrically interconnecting the inserting portion and a wire connection portion of a coated wire. The terminal inserting portion and the wire connecting portion are juxtaposed such that the inserting direction of the partner terminal to be inserted into the terminal inserting portion and the axial center direction of the end of the coated wire to be connected to the wire connecting portion is parallel with or substantially parallel with each other, and are intercoupled via the coupling portion so as to overlap with each other in a direction perpendicular to or substantially perpendicular to both of the inserting direction of the partner terminal and the axial center direction of the end of the coated wire.

9 Claims, 26 Drawing Sheets

CONNECTOR TERMINAL AND CONNECTOR WITH THE CONNECTOR TERMINAL

TECHNICAL FIELD

The present invention relates to a connector terminal adapted to be connected to one end of a coated wire to be electrically connected to a partner terminal, and a connector having the connector terminal and a connector housing.

BACKGROUND ART

There is conventionally known a connector terminal disclosed in Patent Document 1, which is connected to an end of a coated wire constituting a wire harness, for electrically connecting the coated wire to a partner terminal. This connector terminal is shown in FIG. 35. The shown connector terminal, a connector terminal 120, has a terminal inserting portion 130 into which a partner terminal is inserted (connected), and a wire connecting portion 150 to which one end of a coated wire is connected. The terminal inserting portion 130 and the wire connecting portion 150 are so disposed at the front and back that the terminal inserting portion 130 is at the front and the wire connecting portion 150 is at the back, respective axis directions of the portions are on the same or substantially the same line (that is, disposed in a series in the front and back directions).

The shown terminal inserting portion 130 is a female type, formed in a tube shape (a rectangular tube shape) having an opening at its end so as to allow the partner male terminal to be inserted (fitted) along the inserting direction.

The wire connecting portion 150 has a bottom wall 152 extending beyond the terminal inserting portion 130 backward along the axis direction (inserting direction of the partner male terminal), a pair of conductor barrels 154 and 154 rising from both edges of the bottom wall 152 respectively, and a pair of insulation barrels 156 and 156, the pair of conductor barrels 154 and 154 and the pair of insulation barrels 156 and 156 disposed at the front and back along the axis direction of the bottom wall 152. The conductor barrels 154 and 154 are so caulked and crimped as to enclose the exposed core wires of the end of the coated wire placed on the bottom wall 152 between the conductor barrels 154 and 154. In the same manner, the insulation barrels 156 and 156 are so caulked and crimped as to enclose the insulated coating near the exposed core of the coated wire placed on the bottom wall 152 between the insulation barrels 156 and 156.

The connector terminal 120 is held in a given connector housing (not shown). Specifically, the connector housing is formed with a plurality of cavities (terminal holders), into which the connector terminals 120 are inserted in the axis direction respectively. The connector terminals are entirely inserted into the connector housing, which requires the overall length of the connector less than the length of the connector terminal to be inserted, that is, a sum of the length of the terminal inserting portion 130 and the length of the wire connecting portion 150 in the axis direction.

On the other hand, an operation of fitting the connector with the partner connector or separating the connector from the partner connector requires a space (space for fitting operation) greater than the overall length of the connector at the front of the partner connector. However, sufficiently finding the space for fitting operation is difficult, because of the recent increase in the number of components due to the higher performance and multi-functions of various equipment, and the downsizing of the entire equipment to save installation space and cost. In an insufficient space for fitting operation, the fitting or separation operation between the connectors is difficult, and the wiring operation is extremely difficult and complicated.

Patent Document 1: Japanese Patent Application Laid-Open No. 2006-228759

DISCLOSURE OF THE INVENTION

With the foregoing in view, it is an object of the present invention to provide a connector terminal which can be easily fitted to and separated from a partner terminal (partner connector) even if the space for fitting operation is limited in the fitting direction with the partner terminal (partner connector) and a connector having this connector terminal.

To solve the above problem, a connector terminal according to the present invention, which is provided at an end of a coated wire to be connected to a partner terminal, comprises a terminal inserting portion to which the partner terminal is inserted, a wire connecting portion adapted to be connected to the end of the coated wire, and a coupling portion intercoupling and electrically connecting the terminal inserting portion and the wire connecting portion. The terminal inserting portion and the wire connecting portion are intercoupled and electrically interconnected via the coupling portion so as to make an inserting direction in which the partner terminal is inserted into the terminal inserting portion and an axial center direction of the end of the coated wire to be connected to the wire connecting portion parallel or substantially parallel with each other and overlap with each other in a direction perpendicular to or substantially perpendicular to both the inserting direction of the partner terminal and the axial center direction of the end of the coated wire.

The entire length (overall length) of this connector in the fitting (inserting) direction of fitting with the partner terminal is shortened (decreased in length) as compared with a conventional connector terminal. Specifically, since the terminal inserting portion and the wire connecting portion of this connector terminal are so intercoupled as to overlap in a direction perpendicular to or substantially perpendicular to both of the inserting direction of the partner terminal and the axial center direction of the end of the coated wire, the length of the connector terminal in the inserting direction is decreased for the amount of overlap of the terminal inserting portion and the wire connecting portion, as compared with a conventional connector terminal in which the terminal inserting portion and the wire connecting portion are disposed in a series in the inserting direction with the partner terminal. The decrease in length of the terminal facilitates the fitting or separating operation of the connectors even within a limited space in the fitting direction.

BEST MODE FOR CARRYING OUT THE INVENTION

Figure 1:
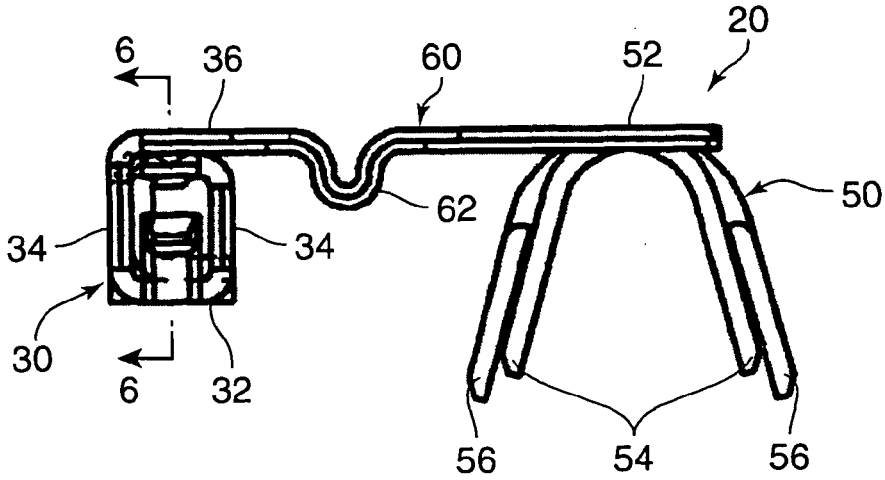
FIG. 1 is a front view depicting a connector terminal according to a first embodiment of the present invention.
Figure 2:
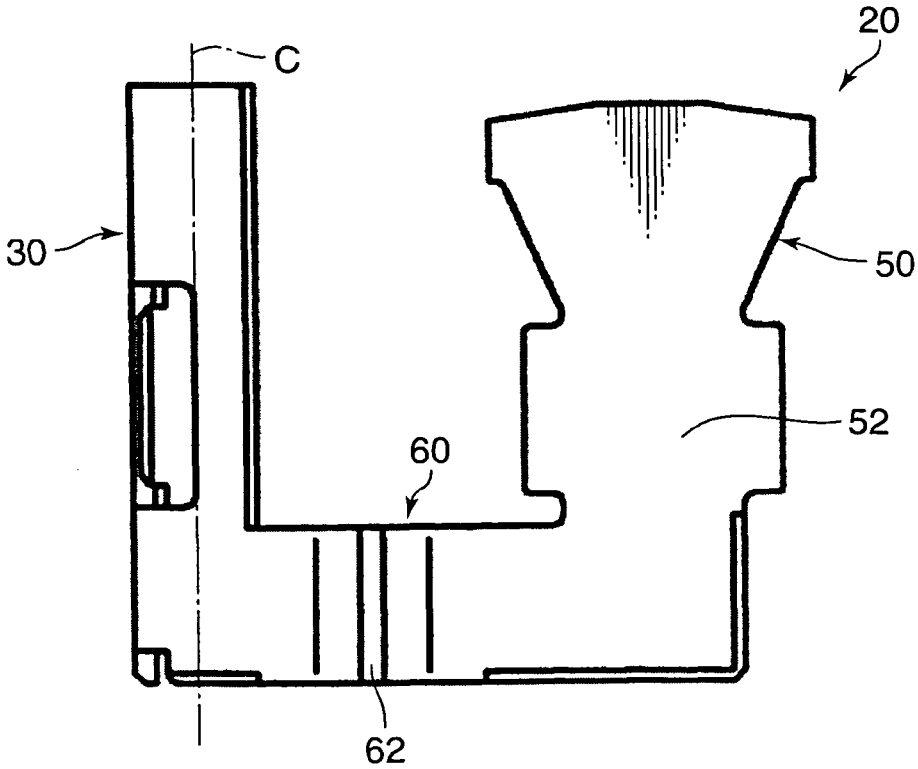
FIG. 2 is a plan view depicting a connector terminal according to this embodiment.
Figure 3:
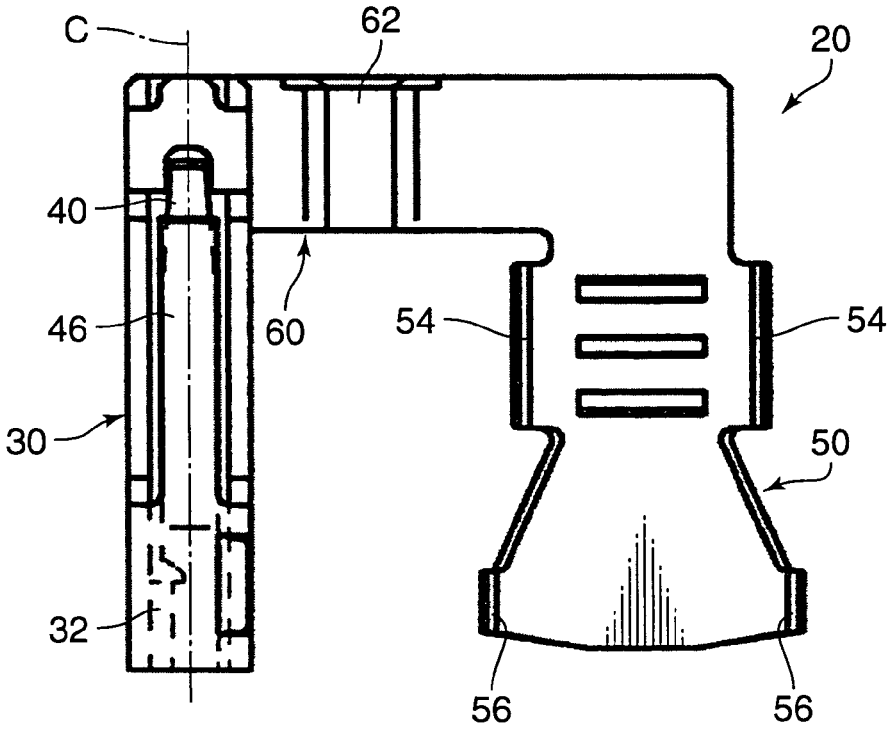
FIG. 3 is a bottom view depicting a connector terminal according to this embodiment.
Figure 4:
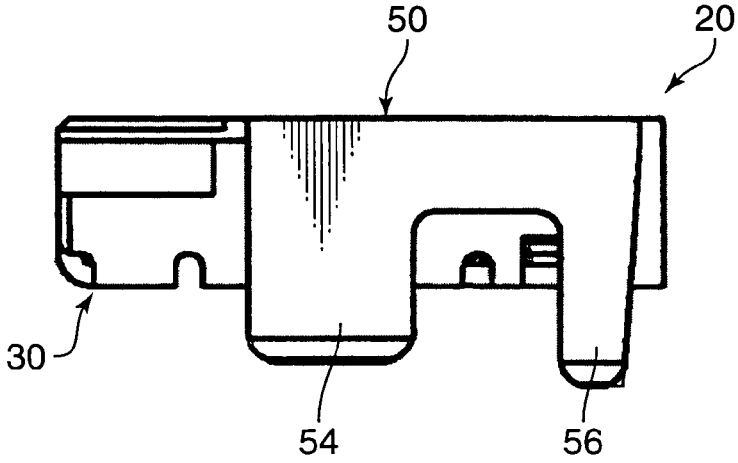
FIG. 4 is a right side view depicting a connector terminal according to this embodiment.
Figure 5:
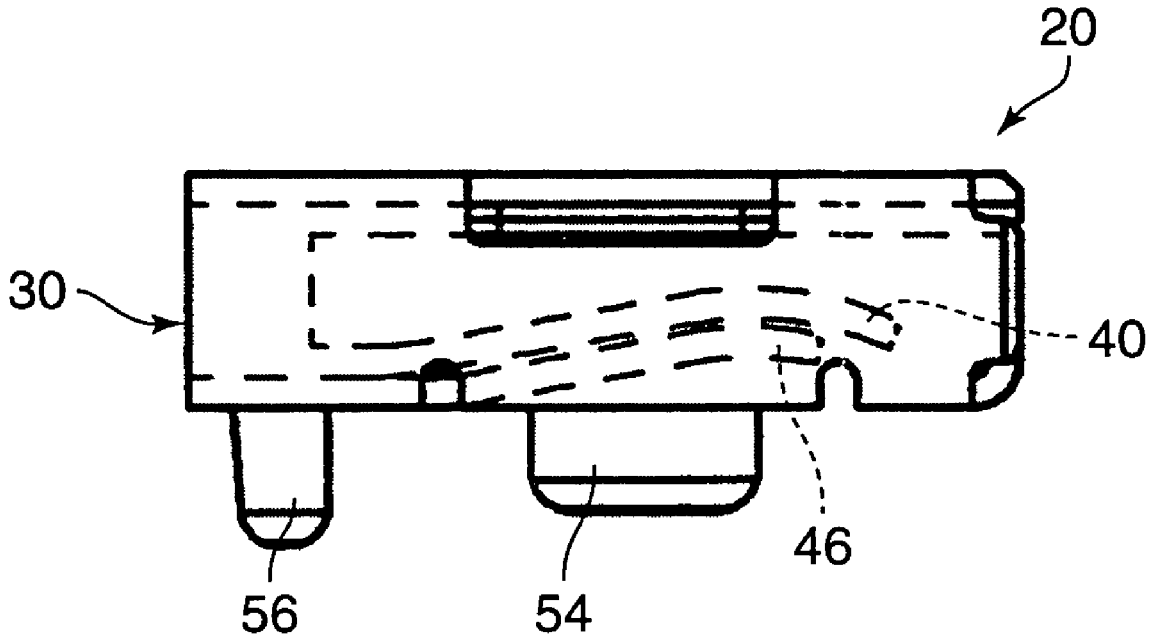
FIG. 5 is a left side view depicting a connector terminal according to this embodiment.

A first embodiment of the present invention will now be described with reference to FIG. 1 to FIG. 14.

According to the present embodiment, given is a connector 10, which is a female connector having a plurality of female type connector terminals 20, 20, . . . and a connector housing (hereafter referred to as "housing") 70. The connector 10 can be fitted to a partner male connector (not illustrated, and hereafter referred to as "partner connector") and be separated from it. The partner connector consists of a number of male type connector terminals (not illustrated, and hereafter referred to as "partner terminals") corresponding to the plurality of connector terminals 20, 20, . . . and a connector housing (not illustrated, and hereafter referred to as "partner housing") which holds the partner terminals.

The connector terminals 20 can be fitted to the partner terminals and be separated from them; the partner terminals are inserted into the terminals 20 to be fitted thereto (are fitted into the terminals 20 ), thus making an electrical interconnection of both of the terminals. As shown in FIG. 1 to FIG. 7, the connector terminal 20 comprises a terminal inserting portion 30 into which the counter terminal is fitted, a wire connecting portion 50 to which an end of a coated wire (hereafter referred to as "wire") W is connected (see FIG. 9 to FIG. 11), and a coupling portion 60 intercoupling and electrically interconnecting the terminal inserting portion 30 and the wire connecting portion 50.

Figure 11:
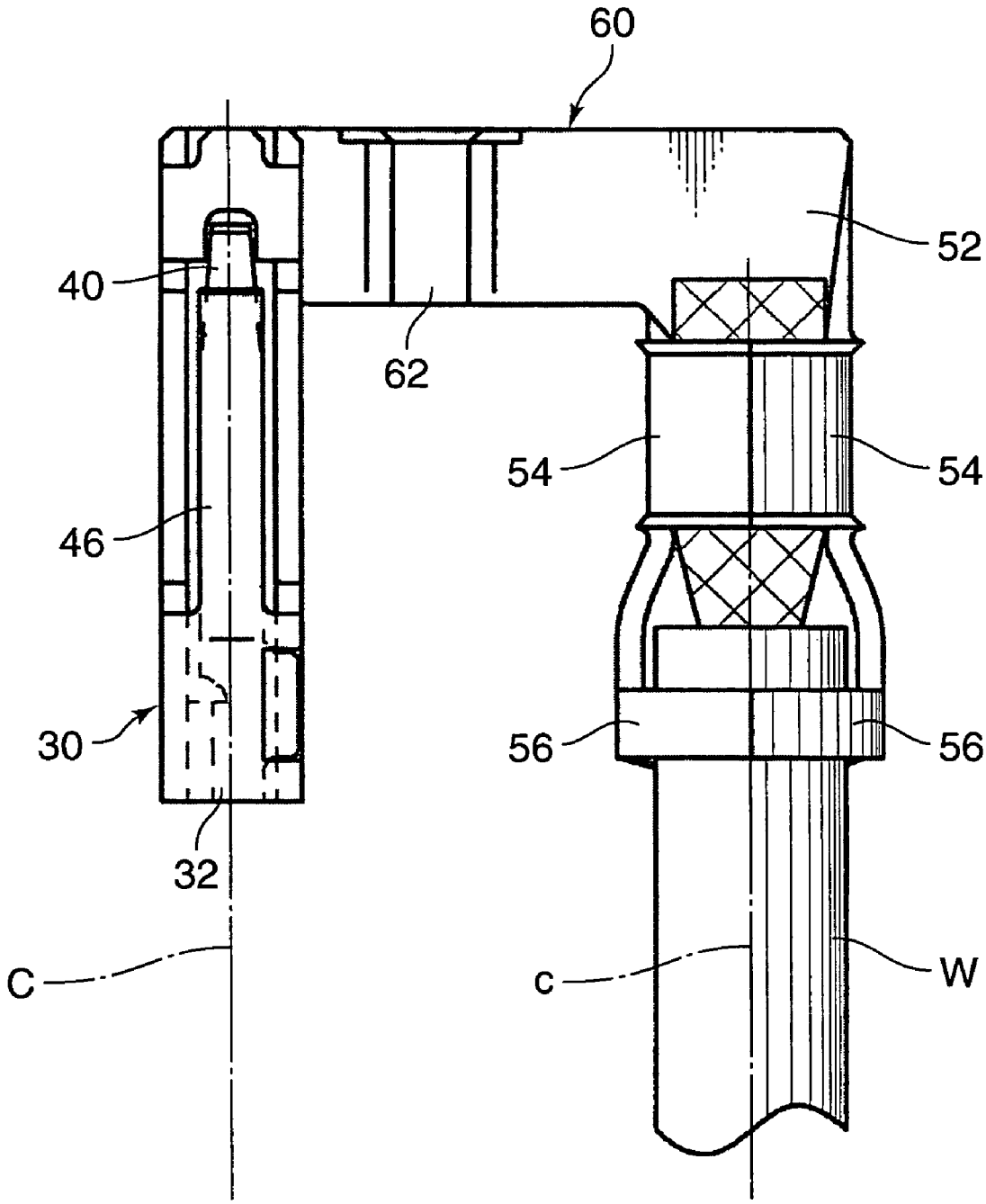
FIG. 11 is a bottom view depicting a state when a coated wire is connected to the connector terminal according to the present embodiment.

As shown in FIG. 11, the terminal inserting portion 30 and the wire connecting portion 50 are so juxtaposed as to make an inserting (fitting) direction C in which the partner terminal is inserted into the terminal inserting portion 30 (central axis direction of the partner terminal T shown in FIG. 6 in the case of the present embodiment) and a later-mentioned axial center direction X of the end of the wire W to be connected to the wire connecting portion 50 parallel or substantially parallel with each other, and so as to overlap in a direction perpendicular to or substantially perpendicular to both of the central axis direction C and the axial center direction X.

The coupling portion 60 intercouples the terminal inserting portion 30 and the wire connecting portion 50 in a direction intersecting with both of the central axis direction C and the axial center direction X. In the present embodiment, the coupling portion 60 intercouples a front end of the terminal inserting portion 30 and a front end of the wire connecting portion 50 in a direction perpendicular to both of the central axis direction C and the axial center direction X. In other words, the terminal inserting portion 30, the wire connecting portion 50 and the coupling portion 60 are disposed in a positional relationship where the terminal inserting portion 30 and the wire connecting portion 50 protrude from opposite ends of the coupling portion 60 in a direction perpendicular to the coupling portion 60, respectively.

Figure 8:
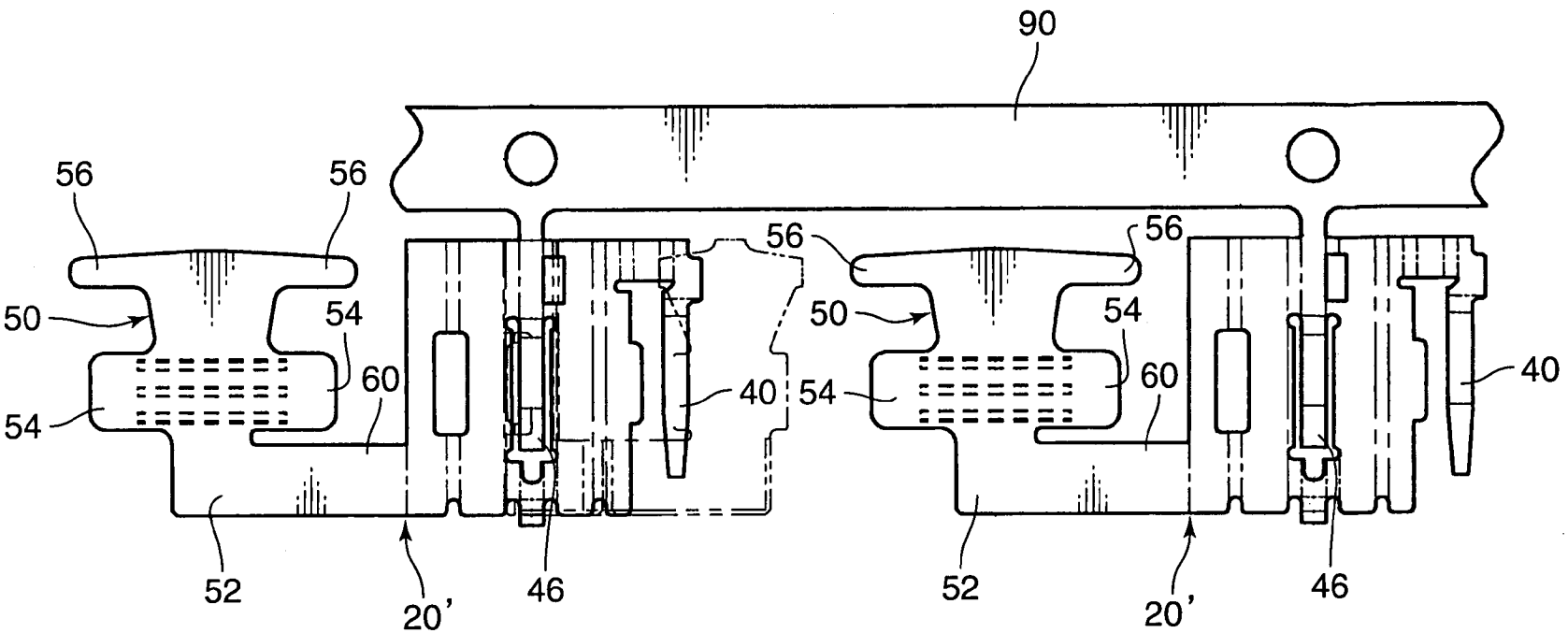
FIG. 8 is a diagram depicting a developed state when the connector terminal according to the present embodiment is intercoupled with a carrier.

The connector terminal 20 is formed by punching a conductive plate (metal plate in the case of the present embodiment) into a predetermined shape, as shown in FIG. 8, and bending this metal plate. Accordingly, at least a part of the terminal inserting portion 30 (base wall 36 of the terminal inserting portion 30 in the case of the present embodiment), at least a part of the wire connection portion 50 (base wall 52 of the wire connecting portion 50 in case of the present embodiment), and the coupling portion 60, are formed by a common plate-like body along a plane including the central axis direction C and the axial center direction X (see FIG. 1 and FIG. 2).

The terminal inserting portion 30 is formed into a long rectangular tube shape along the front and back directions (the central axis direction C), having an opening into which the partner terminal can be inserted, at the front side. Specifically, the terminal inserting portion 30 comprises a bottom wall 32, a pair of side walls 34 and 34 rising from the left and right edges of the bottom wall 32 respectively, and a base wall 36 bridging from the top edges of one side wall 34 to the top edge of the other side wall 34, substantially parallel with the bottom wall 32.

Figure 6:
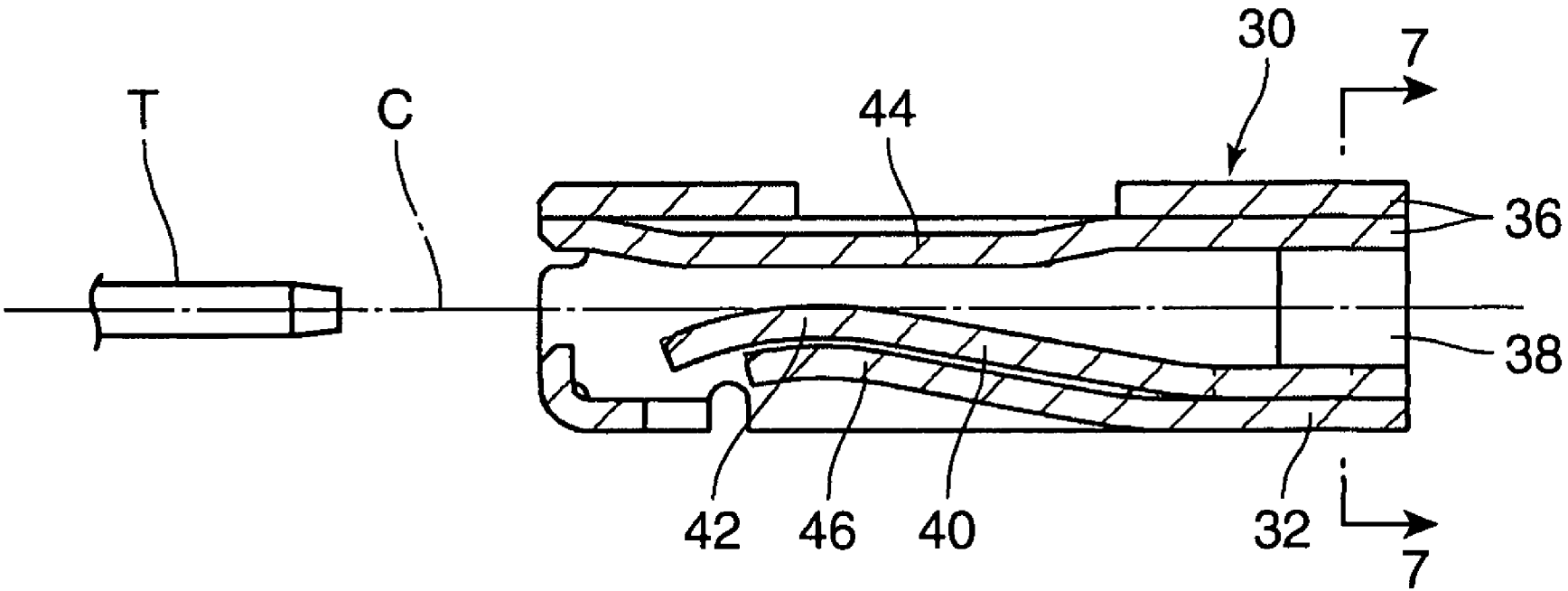
FIG. 6 is a cross-sectional view sectioned in the 6-6 line in FIG. 1.
Figure 7:
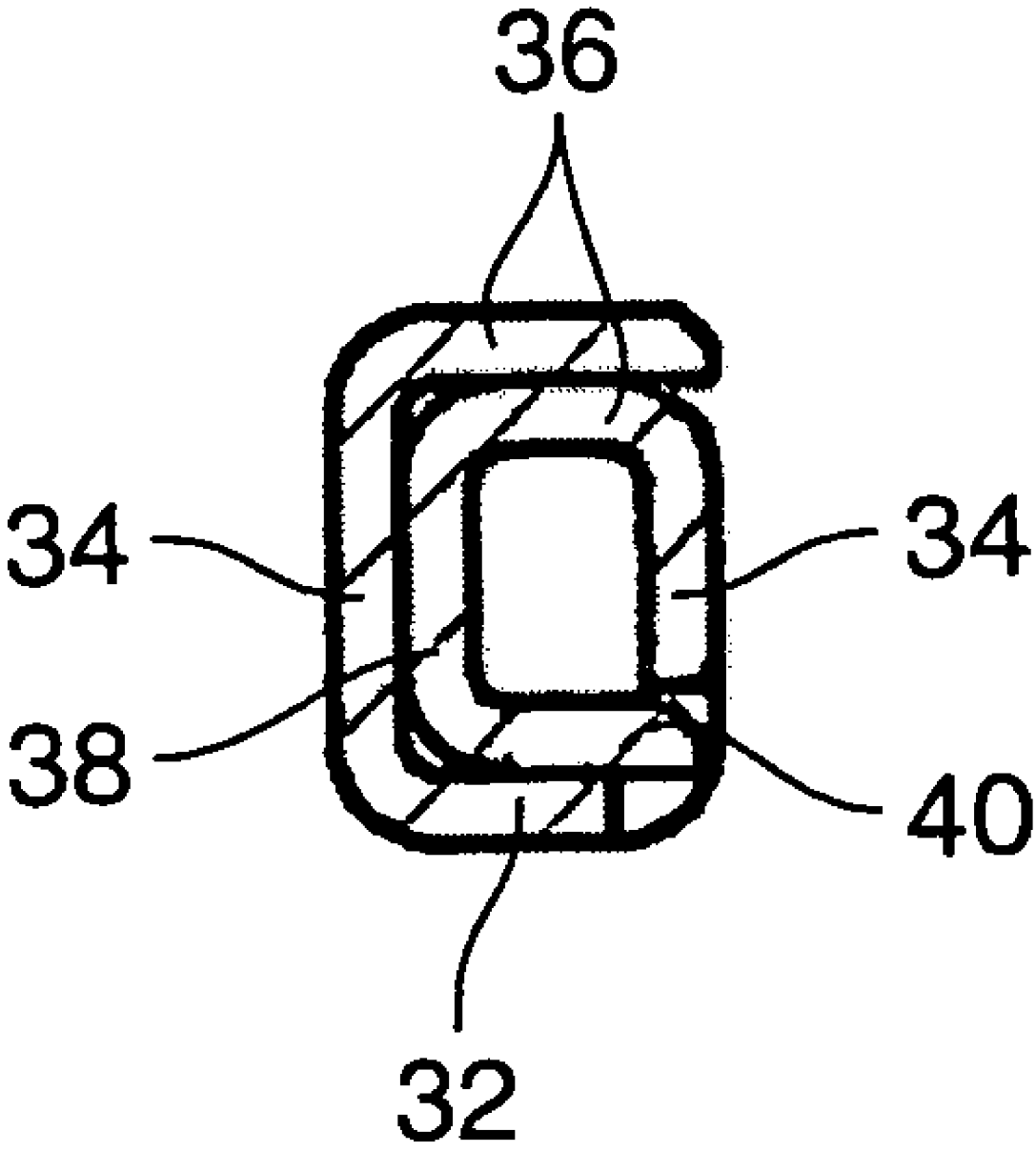
FIG. 7 is a cross-sectional view sectioned in the 7-7 line in FIG. 6.

As shown in FIG. 6 and FIG. 7, the base wall 36 has a two-layer structure. From one side wall 34 at the rear end in the bottom layer, a connecting portion 38 vertically extends down along the other side wall 34, and a plate spring piece 40 extends from the bottom edge of the connecting portion 38 along the bottom wall 32. This spring piece 40 extends from the rear end of the terminal inserting portion 30, inclined upward diagonally, like a cantilever. Its front end portion is a free end inclined slightly downward from the top portion 42.

In the bottom layer of the base wall 36, formed is a pressure receiving portion 44 embossed downward substantially into a rectangular shape. The pressure receiving portion 44 is so positioned as to face the top portion 42 of the spring piece 40, insuring contact pressure between the spring piece 40 and the partner terminal inserted into the terminal inserting portion 30. Specifically, the partner terminal T, when inserted into the terminal inserting portion 30, comes in contact with the top portion 42 of the spring piece 40 to elastically deform the spring piece 40 downward. This elastic deformation of the spring piece 40 causes a spring back force, which presses the counter terminal T upward. As a result, the partner terminal T is held between the pressure receiving portion 44 and the top portion 42 of the spring piece 40, thus electrically connected to them. At this time, the pressure receiving portion 44 prevents the partner terminal T from being raised by the top portion 42 of the spring piece 40, thus insuring the contact pressure.

Near the center of the bottom wall 32 is formed an auxiliary spring piece 46. The auxiliary spring piece 46 is formed in a substantially rectangular shape, and extends cantilever-wise, inclined upward diagonally along the spring piece 40. The auxiliary spring piece 46 is formed by cutting the bottom wall 32 to raise a part thereof, being exposed downward from the terminal inserting portion 30.

The spring piece 40 and the auxiliary spring piece 46, in a free state without deflection (in a state that the partner terminal is not inserted into the terminal inserting portion 30), are separated with a slight gap. However, the partner terminal, when inserted into the terminal inserting portion 30, contacts the spring piece 40 to thereby deflect the spring piece 40 downward, thus making the bottom face of the spring piece 40 touch the auxiliary spring piece 46 from above.

As shown in FIG. 1 to FIG. 5, the wire connecting portion 50 has a base wall (top wall in the case of this embodiment) 52 extending along the axial center direction X of the end of the wire W to be connected, a pair of conductor barrels 54 and 54 and a pair of insulation barrels 56 and 56, the pair of conductor barrels 54 and 54 and the pair of insulation barrels 56 and 56 extending downward from both side edges of the base wall 52. The pair of conductor barrels 54 and 54 and the pair of insulation barrels 56 and 56 are disposed next to each other in the longitudinal direction (the axial center direction X) of the base well 52. Specifically, the pair of conductor barrels 54 and 54 extend downward from both side edges of a front side of the base wall 52 to expand an interval therebetween, while the pair of insulation barrels 56 and 56 extend downward from both side edges of a rear side of the base wall 52 in the back to expand an interval therebetween. Though a pair of conductor barrels 54 and a pair of insulation barrels 56 are formed in the present embodiment, the present invention is not limited to this embodiment, permitting two or more pairs thereof to be formed respectively.

The coupling portion 60 is composed of a plate-like body rectangular in the plan view, intercoupling and electrically interconnecting the terminal inserting portion 30 and the wire connecting portion 50, integrally formed with the base wall 36 of the terminal inserting portion 30 and the base wall 52 of the wire connecting portion 50 in the case of the present embodiment. Specifically, the coupling portion 60, the base wall 36 of the terminal inserting portion 30 and the base wall 52 of the wire connecting portion 50 are constituted by one (common) plate along a plane including the central axis direction C and the axial center direction X. The coupling portion 60 is so disposed as to intercouple a front end portion of the base wall 36 of the terminal inserting portion 30 extending in the central axis direction C and a front end portion of the base wall 52 of the wire connecting portion 50 extending in the axial center direction X in a direction perpendicular to the central axis direction C and the axial center direction X.

Midway (in a central portion in the case of the present embodiment) of the coupling portion 60 in the longitudinal direction (left and right directions in FIG. 1 and FIG. 2), formed are ribs 62 protruding downward. The ribs 62 extend in the front and back directions, enhancing a torsional rigidity of the coupling portion 60 between the central axis direction C and the axial center direction X. Though the ribs 62 according to the present embodiment is formed in a shape of one straight line along the front and back directions, the present invention is not limited to this, accepting a plurality of ribs, a rib shaped in a curved line or an arch-shaped line. In short, the shape and number of ribs are not limited as long as the rib can enhance the above-mentioned torsional rigidity of the plate-like coupling portion 60.

Figure 12:
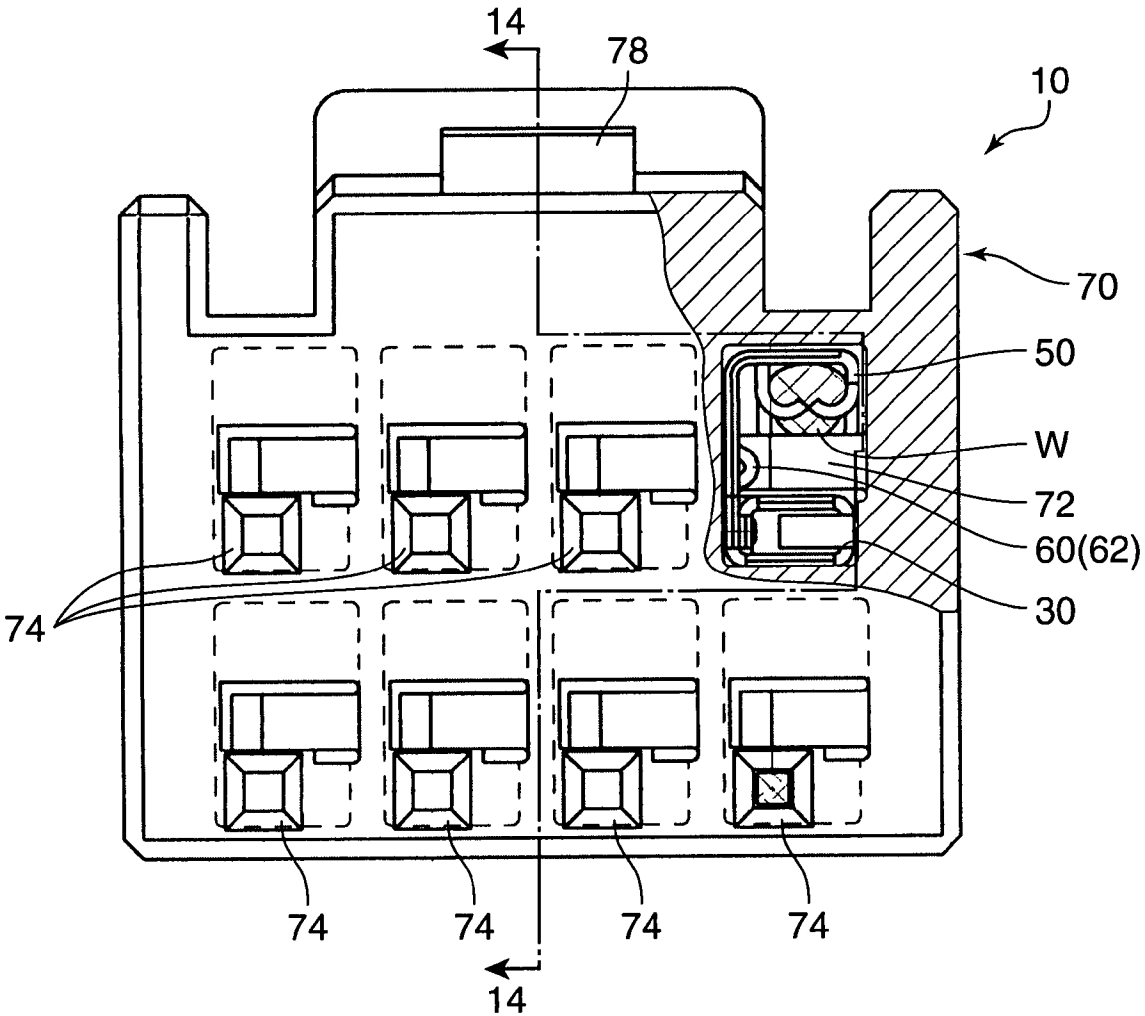
FIG. 12 is a partially sectioned front view depicting a connector according to the present embodiment.
Figure 13:
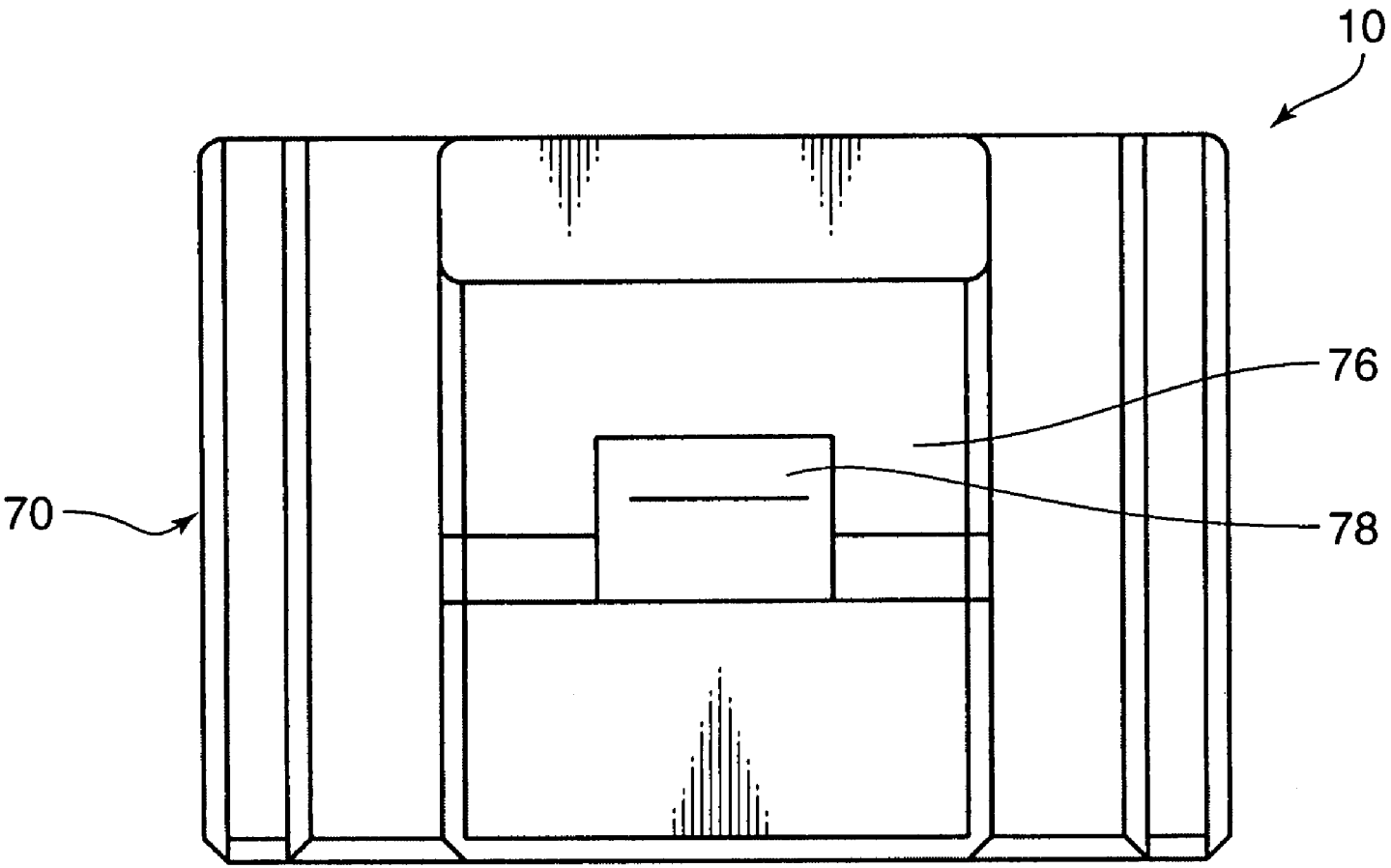
FIG. 13 is a plan view depicting a connector according to the present embodiment.
Figure 14:
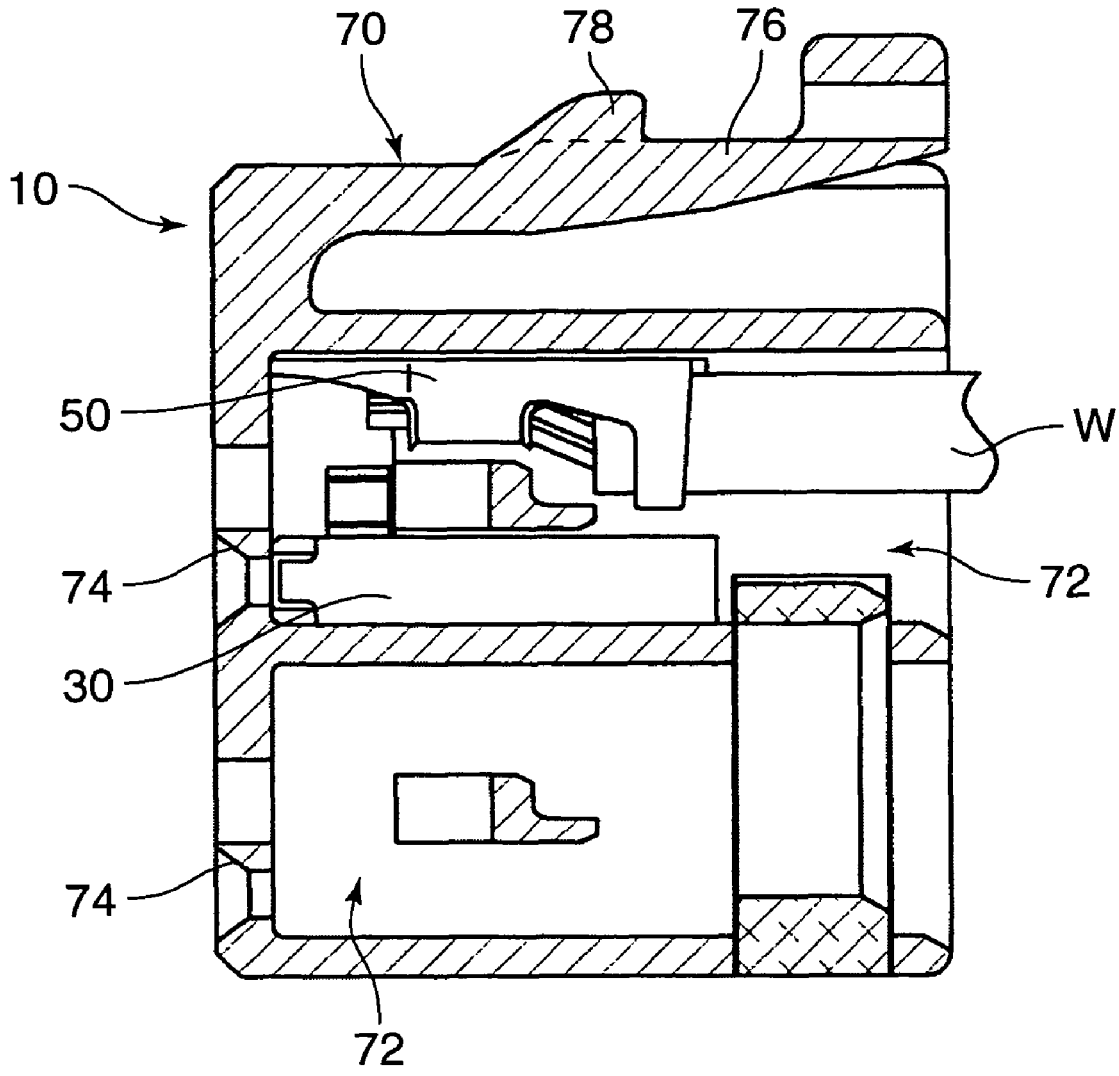
FIG. 14 is a cross-sectional view sectioned in the 14-14 line in FIG. 12.
Figure 15:
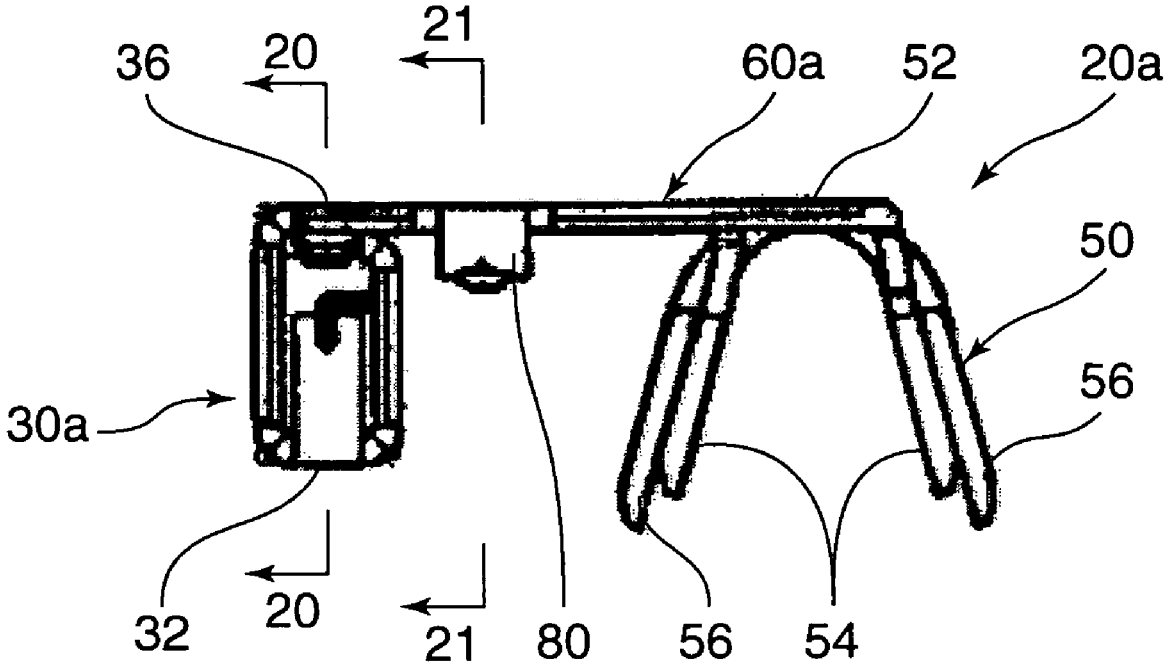
FIG. 15 is a front view depicting a connector terminal according to a second embodiment of the present invention.
Figure 16:
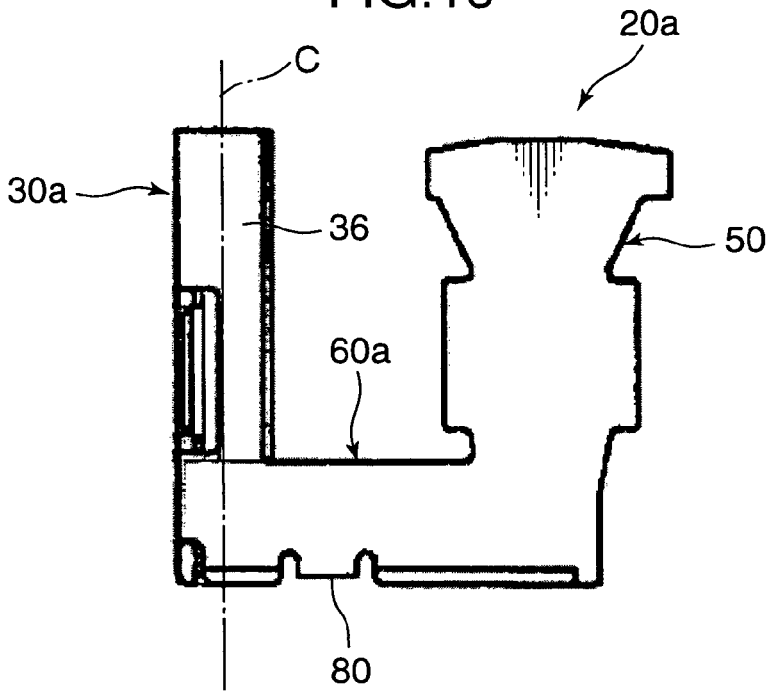
FIG. 16 is a plan view depicting a connector terminal according to the present embodiment.
Figure 17:
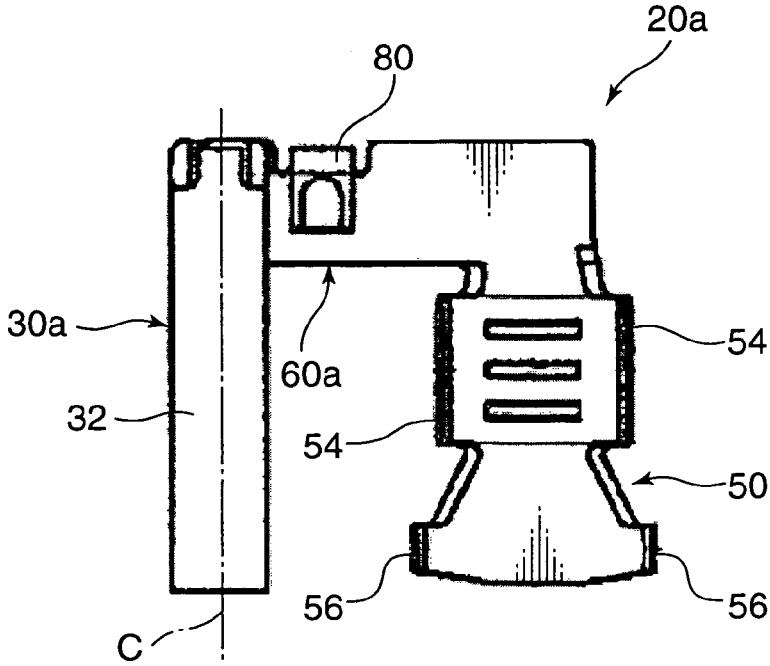
FIG. 17 is a bottom view depicting a connector terminal according to the present embodiment.
Figure 18:
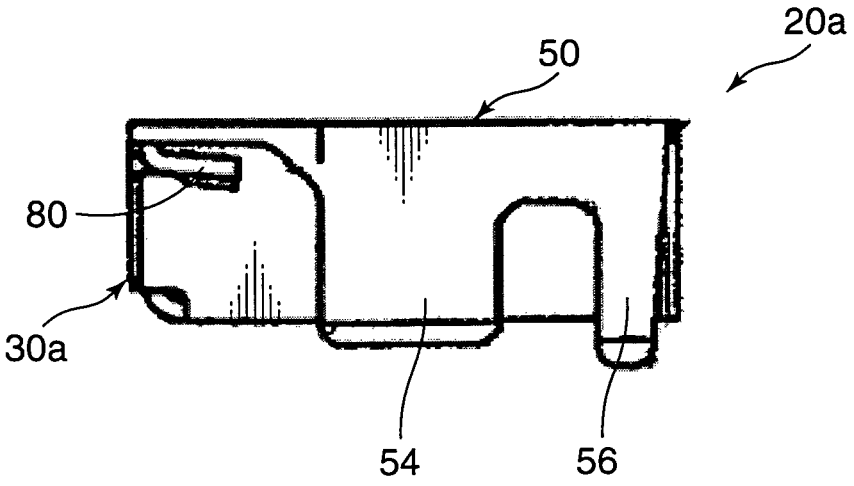
FIG. 18 is a right side view depicting a connector terminal according to the present embodiment.
Figure 19:
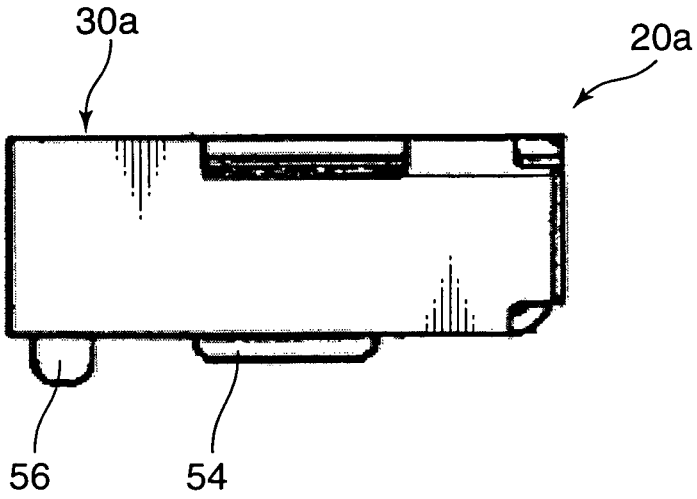
FIG. 19 is a left side view depicting a connector terminal according to the present embodiment.

As shown in FIG. 12 to FIG. 14, the housing 70 is molded of a synthetic resin into a substantially rectangular parallelepiped shape, having a plurality of cavities (connector terminal holders) 72, 72, . . . to which a plurality of connector terminals 20 are inserted (held) respectively. The housing 70 has an upper portion, which is formed with an engaging piece 76 engagable to/detachable from the partner housing.

Each cavity 72 is substantially a rectangular parallelepiped space for storing (inserting) the connector terminal 20, so formed as to extend from the rear face toward the front side in the housing 70. Into the cavity 72 the connector terminal 20 is inserted from the front end side, in the direction from the rear face to the front face in the housing 70. Each cavity 72 has a shape allowing the entire connector terminal 20 to be inserted thereinto.

Each cavity 72 has a shape allowing the connector terminal 20 to be inserted thereinto such that the terminal inserting portion 30 and the wire connecting portion 50 are juxtaposed in the vertical direction, being a vertically long rectangular storing space in the case of the present embodiment. Specifically, as described later, the coupling portion 60 bends, at a position close to the boundary of the wire connecting portion 50 and the coupling portion 60 to which the end of the wire W is connected, at a right angle in a direction of bringing the wire connecting portion 50 closer to the terminal inserting portion 30, and the connector terminal 20 is inserted into each cavity 72 in an attitude that the terminal inserting portion 30 is below the wire connecting portion 50. In other words, the cavity 72 is a vertically long holding space having a width corresponding to an interval between the bottom wall 32 and base wall 36 of the terminal inserting portion 30 from the front view, and a height corresponding to an interval between the side wall 34 of the terminal inserting portion 30 at the opposite side of the wire connecting portion 50 and the base wall 52 of the bent wire connection portion 50.

The cavities 72 are lined up in a direction (horizontal direction in FIG. 12) perpendicular to a direction (vertical direction in FIG. 12) in which the terminal inserting portion 30 and the wire connection portion 50 of the inserted connector terminal 20 are juxtaposed. In other words, the cavities 72, the vertically long rectangular storing spaces from the front view, are lined up in the horizontal direction. In this embodiment, there are vertically arranged two rows each having four cavities 72 horizontally lined up at equally spaced intervals.

The housing 70 has a front side wall, which is provided with a plurality of openings 74, 74, . . . at respective positions corresponding to the cavities 72 and the connector terminals 20 held therein, each opening 74 allowing the partner terminal to be inserted thereinto. In other words, the openings 74, 74, . . . penetrate the front side wall of the housing 70 so as to allow the partner terminal to be fitted into the terminal inserting portion 30 of the connector terminal 20 inserted into the cavity 72 when the connector 10 is fitted to the partner connector.

The locked piece 76 elastically deforms when the housing 70 is fitted to/separated from the partner housing (not illustrated), having an engaging protrusion 78 adapted to engage with the partner housing at the center of the top face.

Next will be described a manufacturing method for the connector terminal 20 and how to use the connector terminal 20 and the housing 70.

The connector terminal 20 is manufactured as follows. First, a conductive plate (metal plate with a 0.2 mm plate thickness in the case of the present embodiment) is pressed, as shown in FIG. 8, to be punched out in a predetermined shape, which includes a plurality of connector terminals 20' in a developed state and strips (so-called carriers) 90 interconnecting the connector terminals 20' in the developed state. Maintaining the connected state, each of the connector terminals 20' and 20 in the developed state is bent following a predetermined procedure, and then parted from the strips 90. A plurality of connector terminals 20 are thus manufactured.

Figure 9:
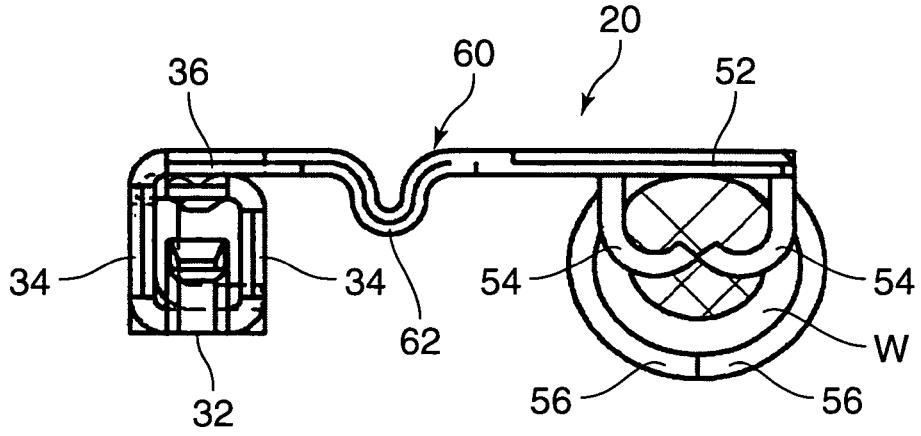
FIG. 9 is a front view depicting a state when a coated wire is connected to the connector terminal according to the present embodiment.
Figure 10:
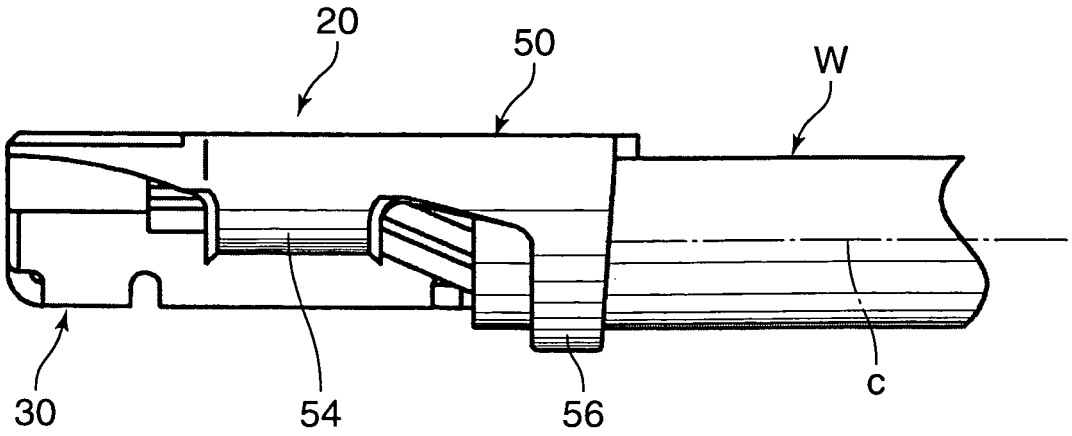
FIG. 10 is a right side view depicting a state when a coated wire is connected to the connector terminal according to the present embodiment.

The connector terminal 20 is used as follows. First, as shown in FIG. 9 to FIG. 11, there is placed an end of the wire W, in which a tip of the conductive core 2 is exposed, into the wire connecting portion 50 of the connector terminal 20 along the longitudinal direction. At this time, the exposed portion of the core 2 at the end of the wire W is positioned between the pair of conductive barrels 54 and 54, while the insulated coating (the insulation layer coating the core) 4 near the exposed core 2 is positioned between the pair of insulation barrels 56 and 56.

Next, the pair of conductive barrels 54 and 54 are so caulked as to enclose the exposed core 2 of the wire W positioned therebetween, thus letting the wire connecting portion 50 be crimped and electrically connected to the core 2 of the wire W. In the same manner, the pair of insulation barrels 56 and 56 are so caulked as to enclose the insulation coating 4 of the wire W positioned therebetween, thus letting the wire connecting portion 50 crimped to also the insulation portion of the wire W and making a firm connection of the wire connecting portion 50 and the wire W.

Then, as shown in FIG. 12, the coupling portion 60 is bent at a position close to the boundary with the wire connecting portion 50 connected to the wire W, thereby decreasing a distance between the wire connection portion 50 and the terminal inserting portion 30. Specifically, the coupling portion 60 is so bent as to form substantively a right angle, from the front view, between the base wall 52 of the wire connecting portion 50 crimped to the wire W and the base wall 36 of the terminal inserting portion 30.

After this bending, the connector terminal 20 is inserted into the cavity 72 of the housing 70 from the front end side in an attitude where the terminal inserting portion 30 of the connector terminal 20 is below the wire connecting portion 50. This insertion involves an alignment of the opening 74 of the housing 70 and the opening at the front end of the tubular terminal insertion portion 30 in the connector terminal 20, thus allowing the partner terminal to be fitted into the terminal inserting portion 30 of the connector terminal 20 from the front face side of the housing 70 through the opening 74. This enables the connector 10 to be electrically connected to the partner connector.

Figure 35:
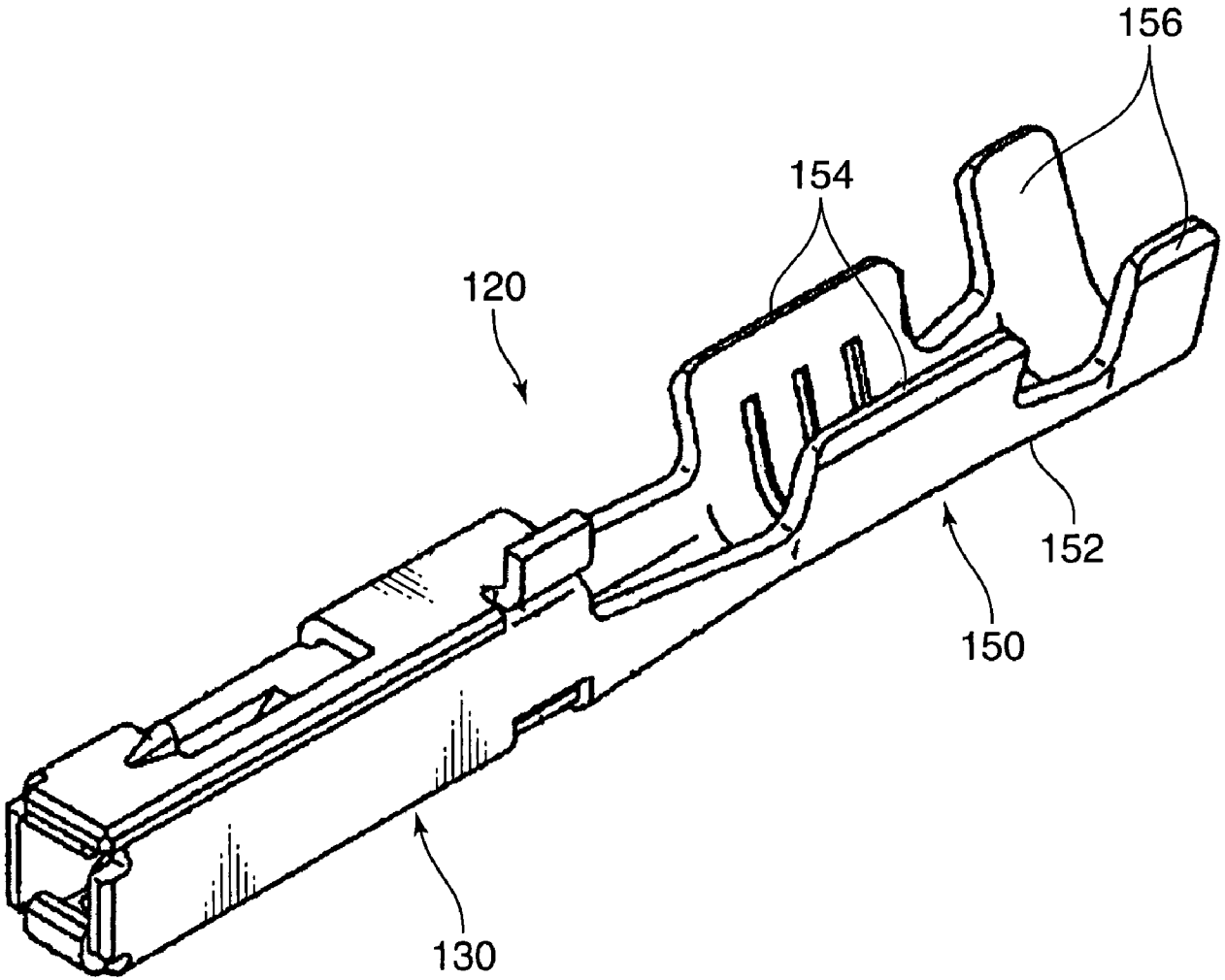
FIG. 35 is a perspective view depicting a conventional connector terminal.

The length of the whole of the above-mentioned connector terminal 20 (overall length) in a fitting (inserting) direction C with the partner terminal is decreased (the connector terminal is shorten), as compared with a conventional connector terminal. Specifically, in the connector terminal 20, since the terminal inserting portion 30 and the wire connecting portion 50 are juxtaposed so as to overlap with each other in a direction perpendicular to or substantially perpendicular to both of the central axis (inserting) direction C of the partner terminal and the axial center direction X of the end of the wire W to be connected, the overall length decreases for the amount of the overlap of the terminal inserting portion 130 and the wire connecting portion 150 in a direction perpendicular to or substantially perpendicular to both of the central axis (inserting) direction C of the partner terminal and the axial center direction X of the end of the wire W, as compared with a conventional connector terminal 120 shown in FIG. 35, where the terminal inserting portion 130 and the wire connecting portion 150 are disposed in a series in the front and back directions.

For example, if the terminal inserting unit 30 and wire connecting unit 50 according to the present embodiment is arranged in a series along the front and back directions to form a conventional connector terminal, and the overall length of the conventional terminal is 15.5 mm, then the overall length of the connector terminal 20 according to the present embodiment in which the terminal inserting portion 30 and the wire connecting portion 50 are juxtaposed via the coupling portion 60 is 5.4 mm, which is about ⅓ of that of a conventional product.

Accordingly, the connector terminal 20 configured as above-mentioned can facilitate an operation for fitting with/separating from the partner terminal even if the space in the fitting direction in the front of the partner terminal (space for fitting operation) is not large.

Furthermore, if at least a part of the terminal inserting portion 30, at least a part of the wire connecting portion 50 and a coupling portion 60 are constructed by a common plate-like body along the plane that includes the central axis direction C and the axial center direction X, then the structure of the connector terminal 20 becomes simple and light weight. This can decrease the number of components and manufacturing steps of the connector terminal 20, resulting in a lowered manufacturing cost.

The coupling portion 60, if formed with the ribs 62, can be given a high torsional rigidity between the central axis direction C and the axial center direction X, even though formed in a plate-like shape. This results in a reduced defect generation rate, the defect generated by bending of the coupling portion due to the connecting operation of the connector terminal 20 to the wire W or inserting operation of the connector terminal 20 into the cavity 72 of the housing 70 during the manufacturing steps of the connector 10.

Furthermore, the housing 70, holding a plurality of the connector terminals 20, 20, . . . (allowing the terminals to be inserted) lined up in a direction perpendicular to the juxtaposing direction of the terminal insertion portion 30 and the wire connecting portion 50, permits its overall length in the longitudinal direction (the central axis direction C) of the connector terminal 20 to be small.

Moreover, in the housing 70 holding a plurality of the connector terminals 20, 20, . . . so as to arrange the connector terminals 20 in a direction perpendicular to the juxtaposing direction of the terminal inserting portion 30 and the wire connecting portion 50, the distance (pitch) between adjacent connector terminals 20 and 20 can be kept to a pitch equivalent to the pitch between conventional terminals in each of which the terminal inserting portion and the wire connection portion are connected in series. In other words, in the above-mentioned connector 10, the overall length of the housing 70 in the fitting direction with the partner connector can be decreased, as compared with a conventional connector, without increasing its width in a direction in which the connector terminals 20, 20, . . . are lined up. As a result, the length of the connector 10 in the fitting direction can be reduced without increasing the width in the line up direction of the connector terminals 20, 20, . . . as compared with a conventional connector, thereby enabling the connector 10 to be easily fitted with/separated from the partner terminal (partner connector) even within a little space for fitting operation.

Now a second embodiment will be described with reference to FIG. 15 to FIG. 25. Here the composing elements the same as the first embodiment are denoted with the same symbols, for which detailed description is omitted, and only different composing elements will be described in detail.

FIG. 15 to FIG. 19 shows a connector terminal 20*a* according to the present embodiment, which comprises a wire connecting portion 50, a terminal inserting portion 30*a* and a coupling portion 60*a*.

Figure 20:
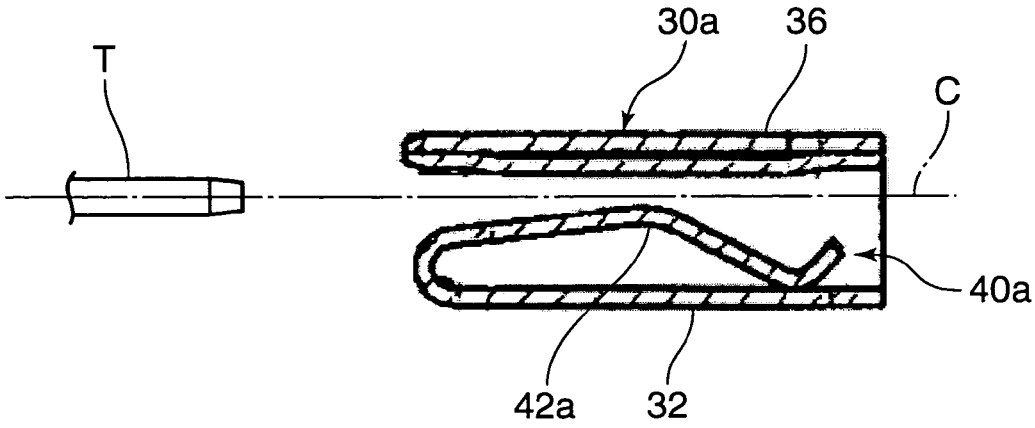
FIG. 20 is a cross-sectional view sectioned in the 20-20 line in FIG. 15.

The terminal inserting portion 30*a* is formed like a rectangular tube, having a bottom wall 32 shown in also FIG. 20 and a spring piece 40*a*, the spring piece 40*a* extending from the tip of the bottom wall 32 and folded backward. This spring piece 40*a* extends from the tip of the bottom wall 32 of the terminal inserting portion 30*a* toward the back, inclined upward diagonally. The spring piece 40*a* has a center portion (top portion) 42*a* from which the spring piece 40*a* extends downward diagonally to the bottom wall to touch the bottom wall 32, and an edge directing upward again diagonally.

In the spring piece 40*a* having such a shape, the top portion 42*a* contacts the partner terminal T inserted into the terminal inserting position 30*a* to be displaced downward involving elastic deformation of the spring piece 40*a*. This elastic deformation causes a spring back force, which lets the spring piece 40*a* push the partner terminal T upward to press it against the base wall 36. In other words, the base wall 36 and the top portion 42*a* of the spring piece 40*a* hold the partner terminal T therebetween. This provides an electrical connection of both terminals.

Figure 21:
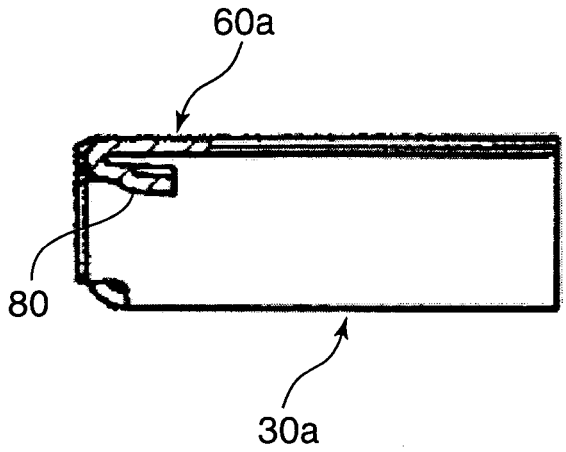
FIG. 21 is a cross-sectional view sectioned in the 21-21 line in FIG. 15.
Figure 22:
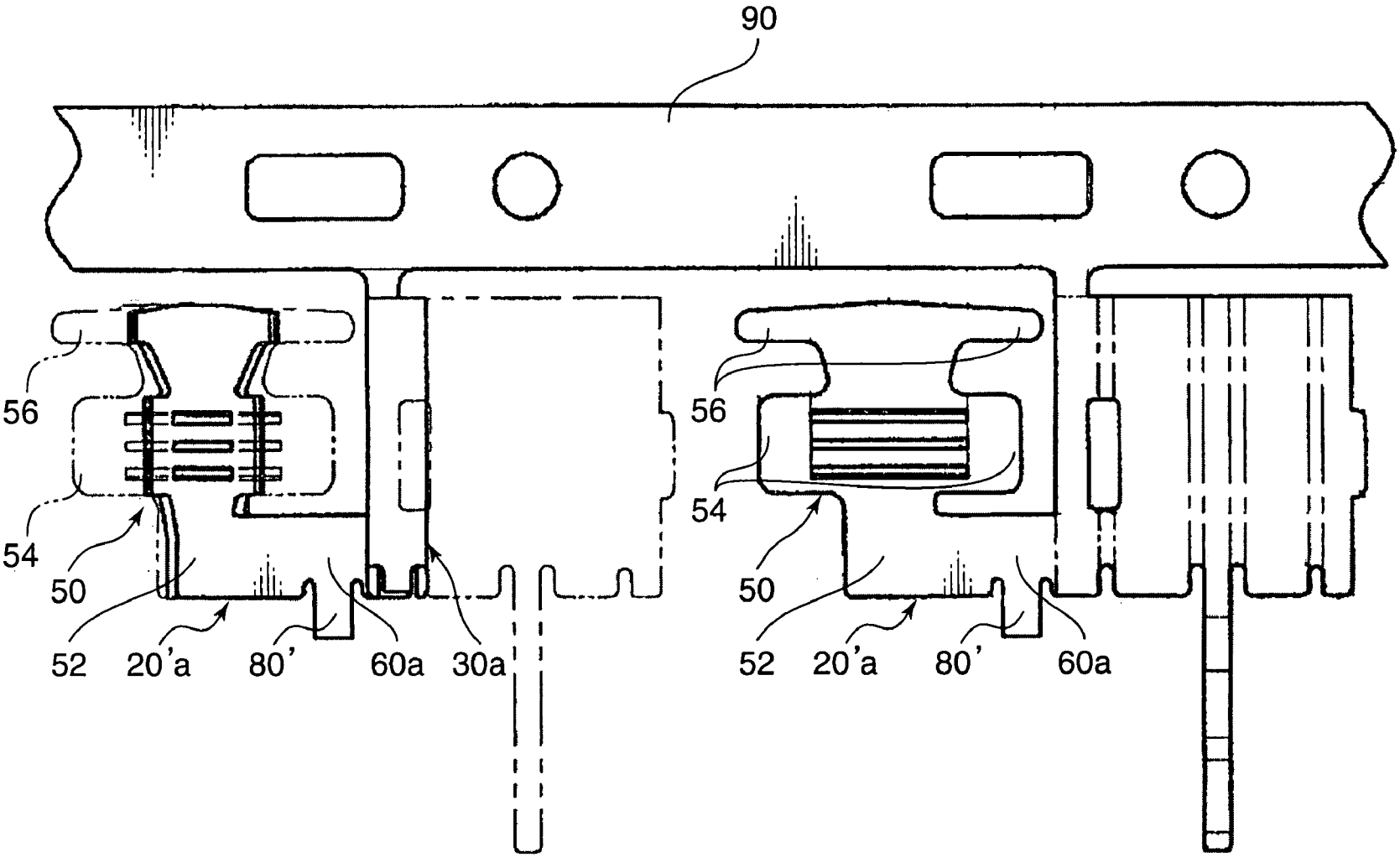
FIG. 22 is a diagram depicting a developed state when the connector terminal according to this embodiment is intercoupled with a carrier.

The coupling portion 60*a* is formed with a locked piece (locked portion) 80 located midway between the terminal inserting portion 30*a* and the wire connecting portion 50. The locked piece 80 is adapted to be locked by a lance formed in a cavity 72 of the connector housing 70. In the present embodiment, formed is a protrusion 80' (see FIG. 22) at a frond end side of the coupling portion 60*a*, as shown in FIG. 22, the protrusion 80' being folded back as shown in FIG. 21 to form the locked piece 80.

This connector terminal 20*a* is formed in the same way as the first embodiment. Specifically, a conductive plate is so pressed as to be punched out in a predetermined shape (connector terminal 20'*a* in a developed shape), as shown in FIG. 22; this punched out connector terminal 20'*a* is bent according to a predetermined procedure and thereafter parted from the strips 90: the connector terminals 20*a* are thus manufactured.

Figure 23:
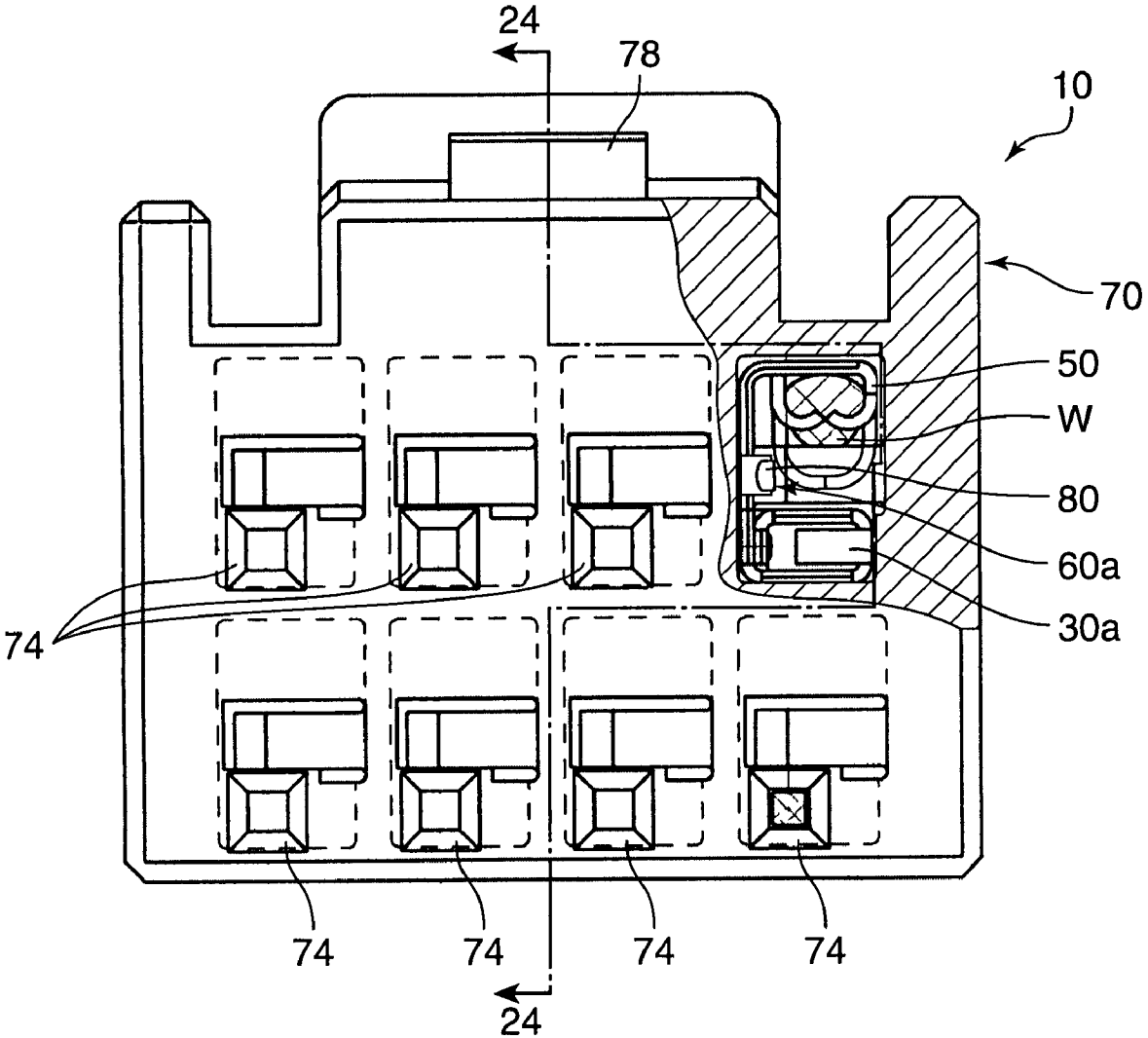
FIG. 23 is a partially sectioned front view depicting the connector according to the present embodiment.
Figure 24:
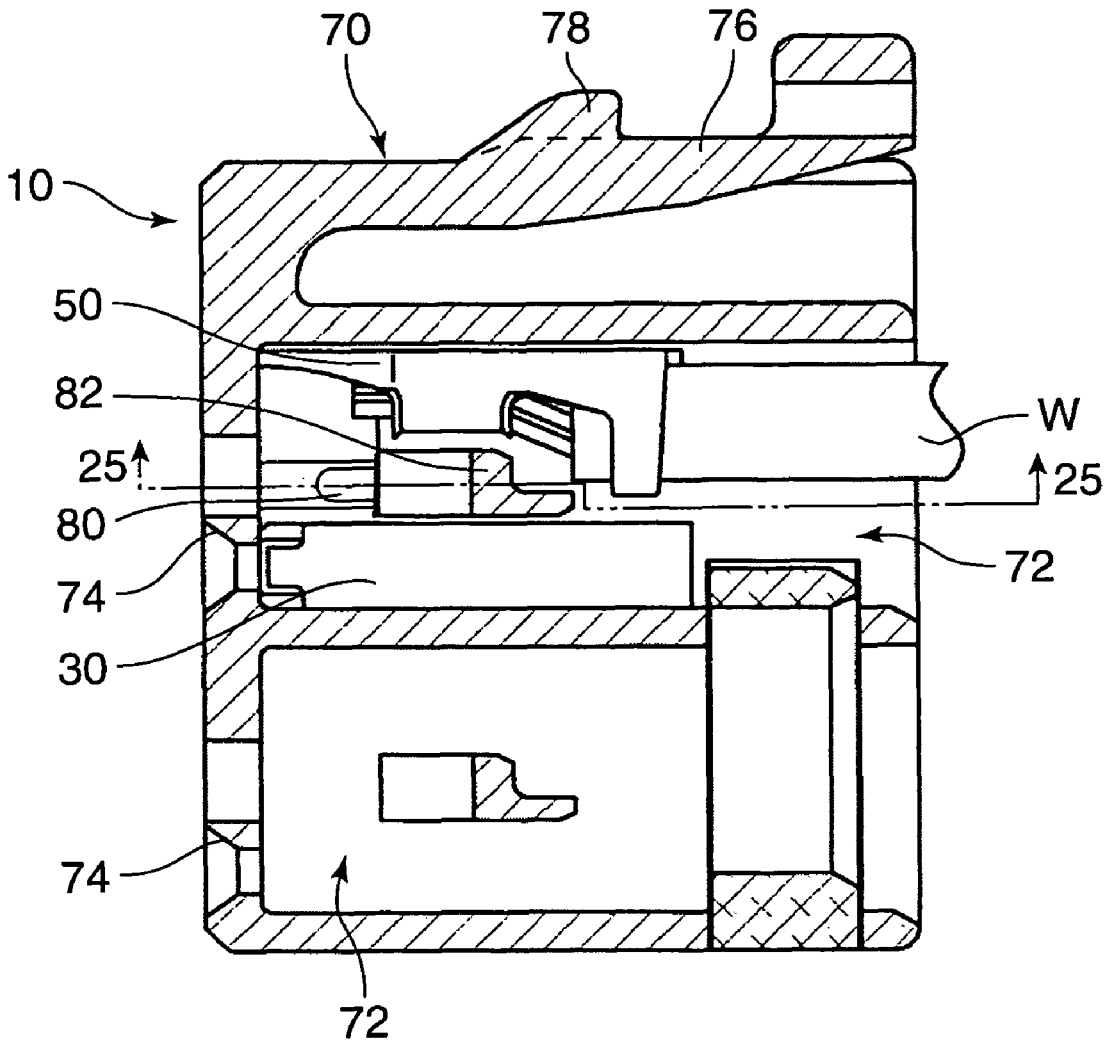
FIG. 24 is a cross-sectional view sectioned in the 24-24 line in FIG. 23.
Figure 25:
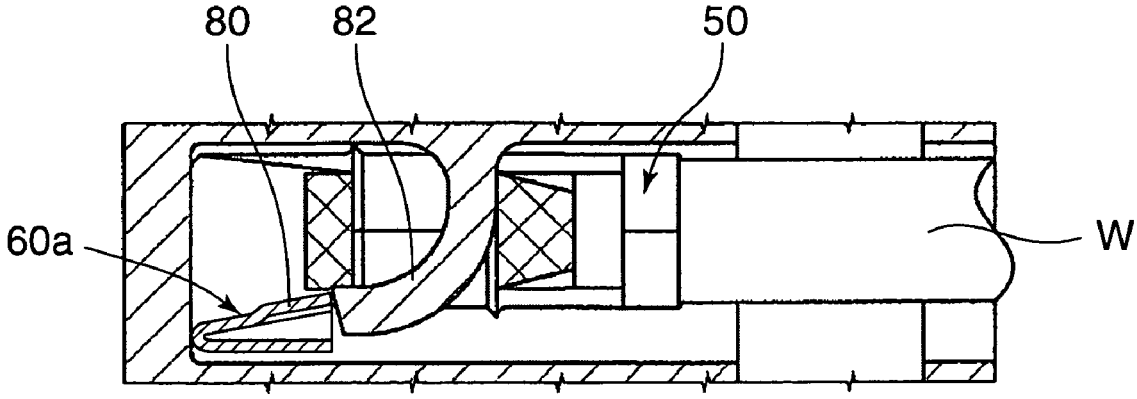
FIG. 25 is a cross-sectional view sectioned in the 25-25 line in FIG. 24.

As shown in FIG. 23 to FIG. 25, lances 82 are provided to protrude into the respective cavities 72 of the housing 70. Each the lance 82 protrudes from an inner side wall of the cavity 72 in the horizontal direction, while curved in the forward direction and positioned between the terminal inserting portion 30*a* and the wire connecting portion 50 of the connector terminal 20*a* held in the cavity 72.

Similarly to the first embodiment, the connector terminal 20*a* is bent at a position close to the boundary of the wire connecting portion 50 and the coupling portion 60*a* to which the wire W is connected, then inserted into the cavity 72 in the housing 70. This insertion involves contact of the locked piece 80 with the lance 82 to elastically deform the lance 82, but the following passage of the locked piece 80 over the lance 82 allows the lance 82 to return to the original state of no elastic deformation to thereby make an engagement of the tip of the lance 82 with the locked piece 80. The connector terminal 20*a* is thus locked within the cavity 72 (see FIG. 25).

The entire connector terminal 20*a* according to the present embodiment can be short in a fitting direction C with the partner terminal, similarly to the first embodiment. Specifically, in the case of the connector terminal 20*a*, similarly to the first embodiment, the overall length decreases for the amount of the overlap of the terminal inserting portion 30*a* and the wire connecting portion 50 in a direction perpendicular to or substantially perpendicular to both of the central axis (inserting) direction C of the partner terminal T and the axial center direction X of the end of the wire W, as compared with a conventional connector terminal 120 in which the terminal inserting portion 130 and the wire connecting portion 150 are disposed in a series. This facilitates an operation for fitting with/separating from the partner terminal, as compared with a conventional connector terminal, even within a little space in the fitting direction in the front of the partner terminal.

Moreover, the coupling portion 60*a*, having a locked piece (locked portion) 80 to be locked by the lance 82 formed in the inner surface of the cavity 72 of the connector housing 70 in the midway position between the terminal inserting portion 30*a* and the wire connecting portion 50, ensures the lock of the connector terminal 20*a* having the coupling portion 60*a* within the cavity 72. Hence, the connector terminal 20*a* is positively held in the connector housing 70 against vibrations during used.

Besides, for exactly the same reason as the first embodiment, the overall length of the housing (length in the central axis direction C) can be decreased without increasing the width of the housing 70 for holding the connector terminal 20*a* as compared with a conventional connector terminal.

Now a third embodiment will be described with reference to FIG. 26 to FIG. 32.

Figure 26:
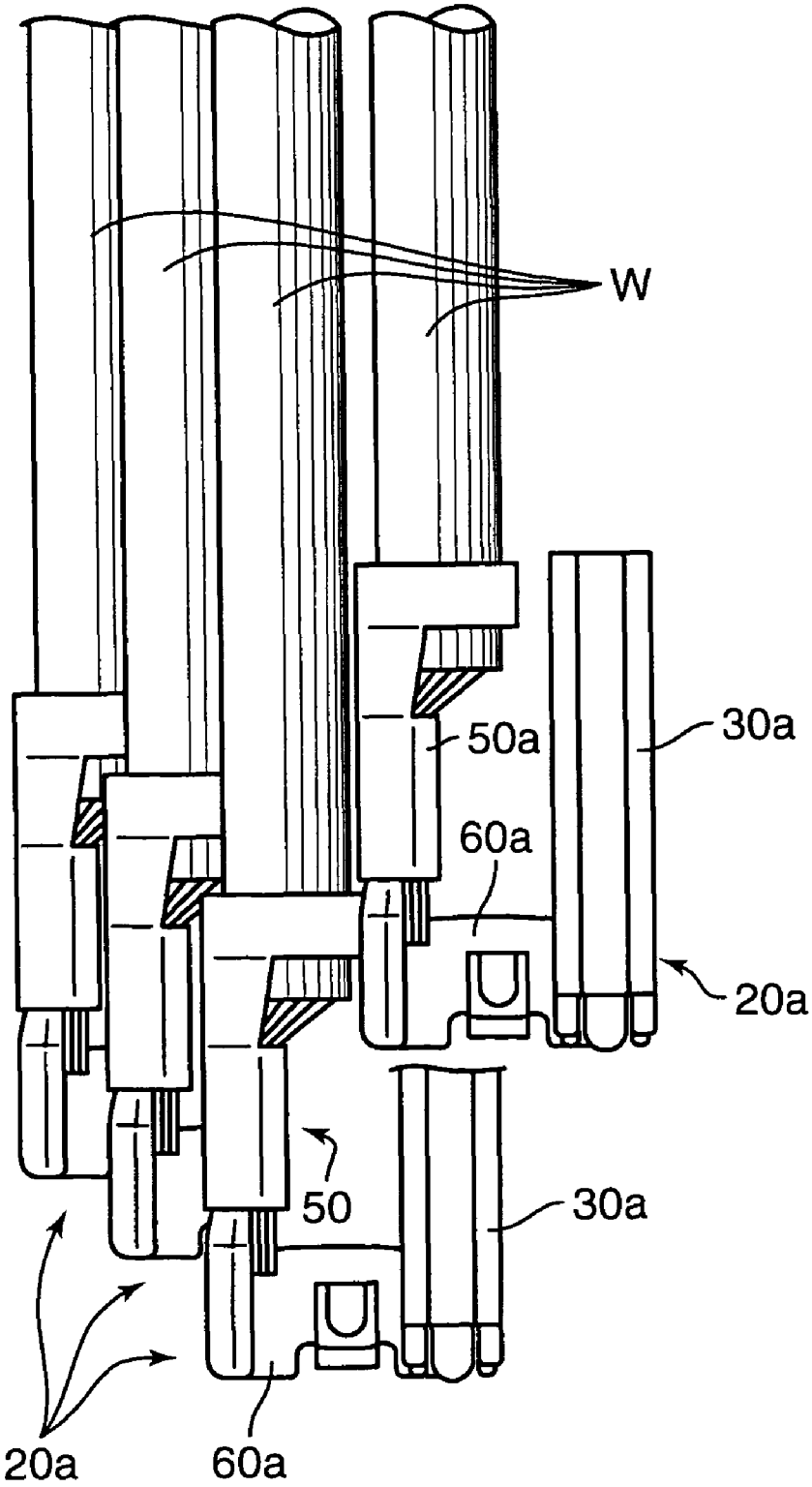
FIG. 26 is a bottom view depicting a state when a plurality of wires which are bundled and to which the connector terminal according to the present embodiment is crimped.
Figure 27:
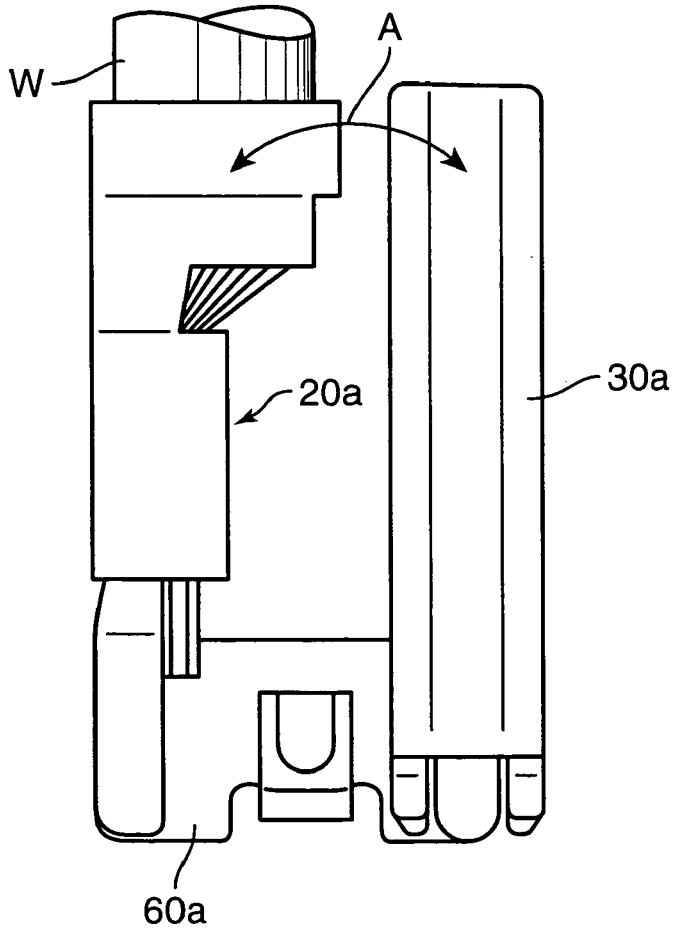
FIG. 27 is a bottom view depicting a direction of deformation which could occur to the connector terminal according to the present embodiment.

The problem to be solved by the third embodiment is to suppress deformation and damage of a connector terminal. For example, in a state where the connector 20*a* according to the second embodiment is crimped to the end of the wire W as shown in FIG. 26, the terminal inserting portion 30*a* of the connector terminal 20*a*, which is offset from the wire connecting portion 50*a* and the central axis of the wire W to which the connector terminal 20*a* is crimped, tends to be hooked with other foreign objects. Particularly when a plurality of wires W each having an end to which the connector terminal 20*a* is crimped are bundled as shown in FIG. 26, the connectors 20*a* are easily hooked with each other. Such hooking tends to involve deformation of the connector terminal 20*a*, particularly such deformation as to open the terminal inserting portion 30*a* from the wire connecting portion 50, as shown by the arrow A in FIG. 27.

In view of the fact, provided is a connector terminal 20*b* according to the third embodiment, which comprises not only a basic component including the connector terminal 20*a* according to the second embodiment but also a left and right pair of protective portions 58 shown in FIG. 28 to FIG. 32.

Figure 31:
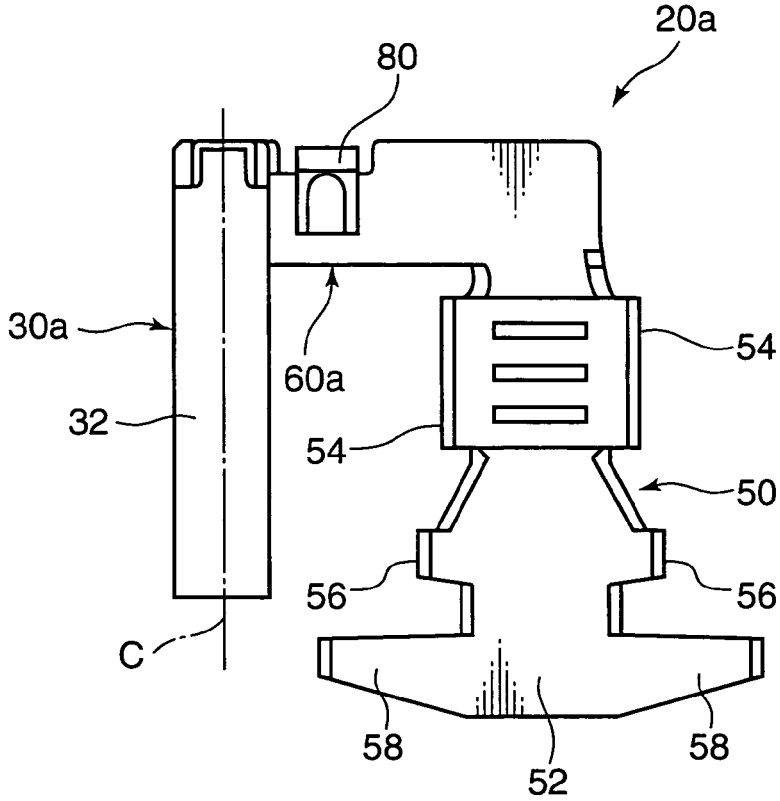
FIG. 31 is a bottom view depicting a state of the connector terminal before crimping according to the present embodiment.
Figure 32:
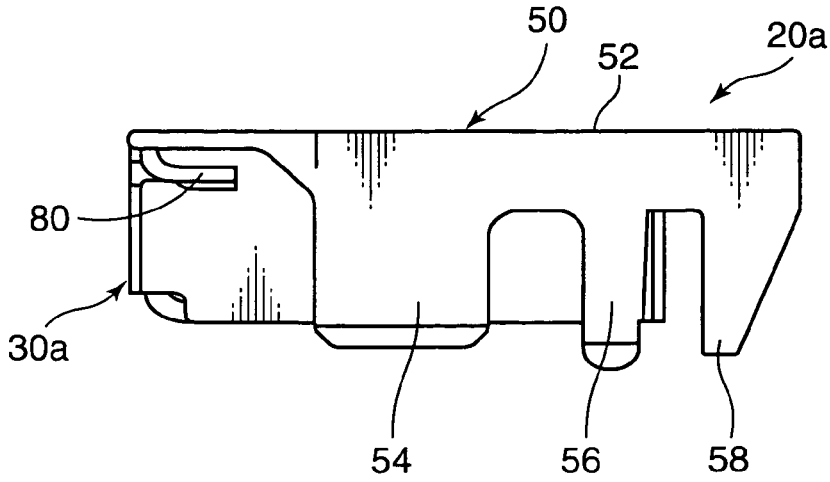
FIG. 32 is a side view depicting the state in FIG. 31.

The protective portions 58 are formed in the wire connecting portion 50, extending from the base wall 52 of the wire connecting portion 50 at positions behind the pair of insulation barrels 56 in the wire connecting portion 50 (at positions more distant from the coupling portion 60*a*). The protective portions 58 are so bent together with the insulation barrels 56 as to be formed in a shape of covering the terminal inserting portion 30*a* from the opposite side of the coupling portion 60*a* (that is, from rear side). Specifically, the protective portions 58 in the state shown in FIG. 31 and FIG. 32 are so bent as to let the tips of the left and right protective portions 58 come in contact with each other or close to each other as shown in FIG. 28 to FIG. 30, and then the coupling portion 60*a* is bent substantially at a right angle similarly to the second embodiment, thus located so as to prevent foreign objects (e.g. another terminal) from coming in contact with the terminal inserting portion 30*a* from the back.

In the connector terminal 20*b* of the third embodiment, the deformation of the connector terminal 20*b* due to the terminal inserting portion 30*a* hooked with another terminal can be effectively suppressed by a simple and inexpensive structure comprising the conductor barrels 54 and insulation barrels 56 of the wire connecting portion 50 and the simply added protective portions 58 similar to the barrels 54 and 56.

Figure 28:
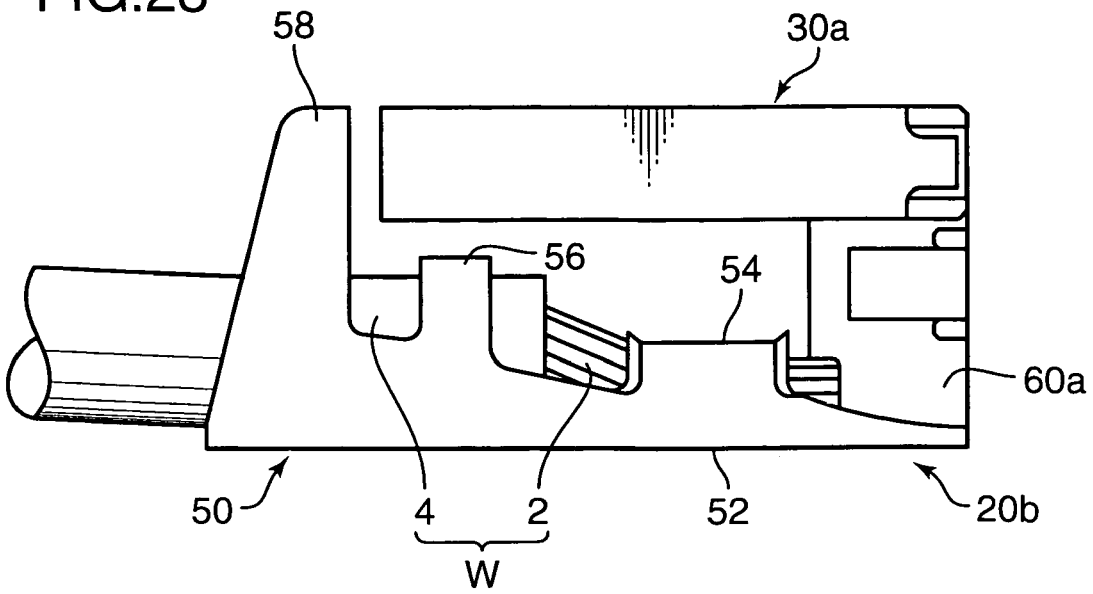
FIG. 28 is a bottom view depicting a connector terminal according to a third embodiment of the present invention.
Figure 29:
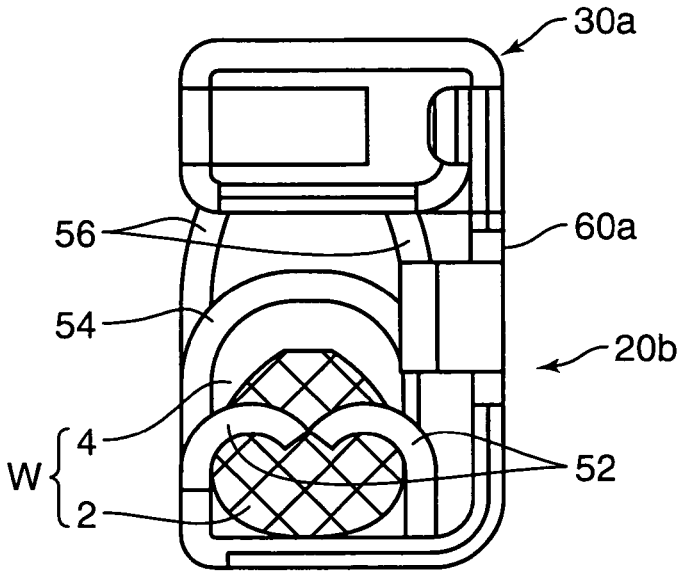
FIG. 29 is a front view depicting the connector terminal according to the present embodiment.
Figure 30:
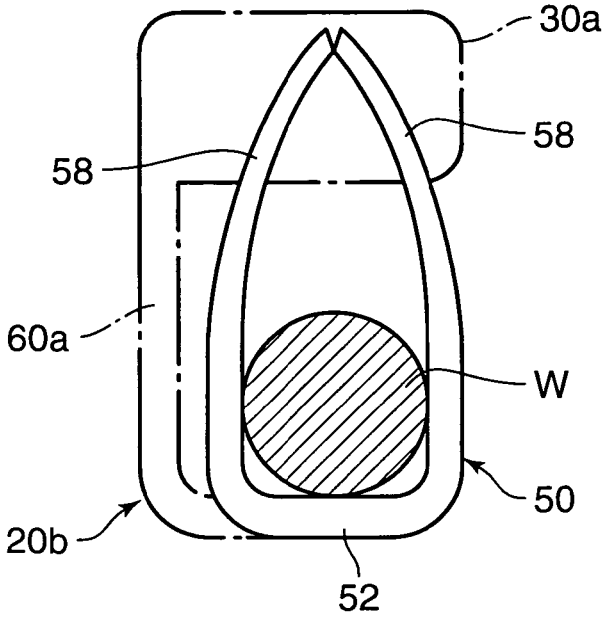
FIG. 30 is a rear view depicting the connector terminal according to the present embodiment.

The shape of the protective portions 58 is not limited to FIG. 28 to FIG. 30; other shapes for effective protection of the terminal inserting portion 30*a* can be adopted. For example, the tips of the protective portions 58 may be curved toward the wire W side.

Also the connector terminal 20*b* according to the third embodiment is allowed to be held in the housing 70 shown in FIG. 14 and FIG. 24, for example, by determining the shape of the cavity 72 so as to permit also the protective portions 58 of the connector terminal 20*b* to be inserted into the cavity 72.

Figure 33:
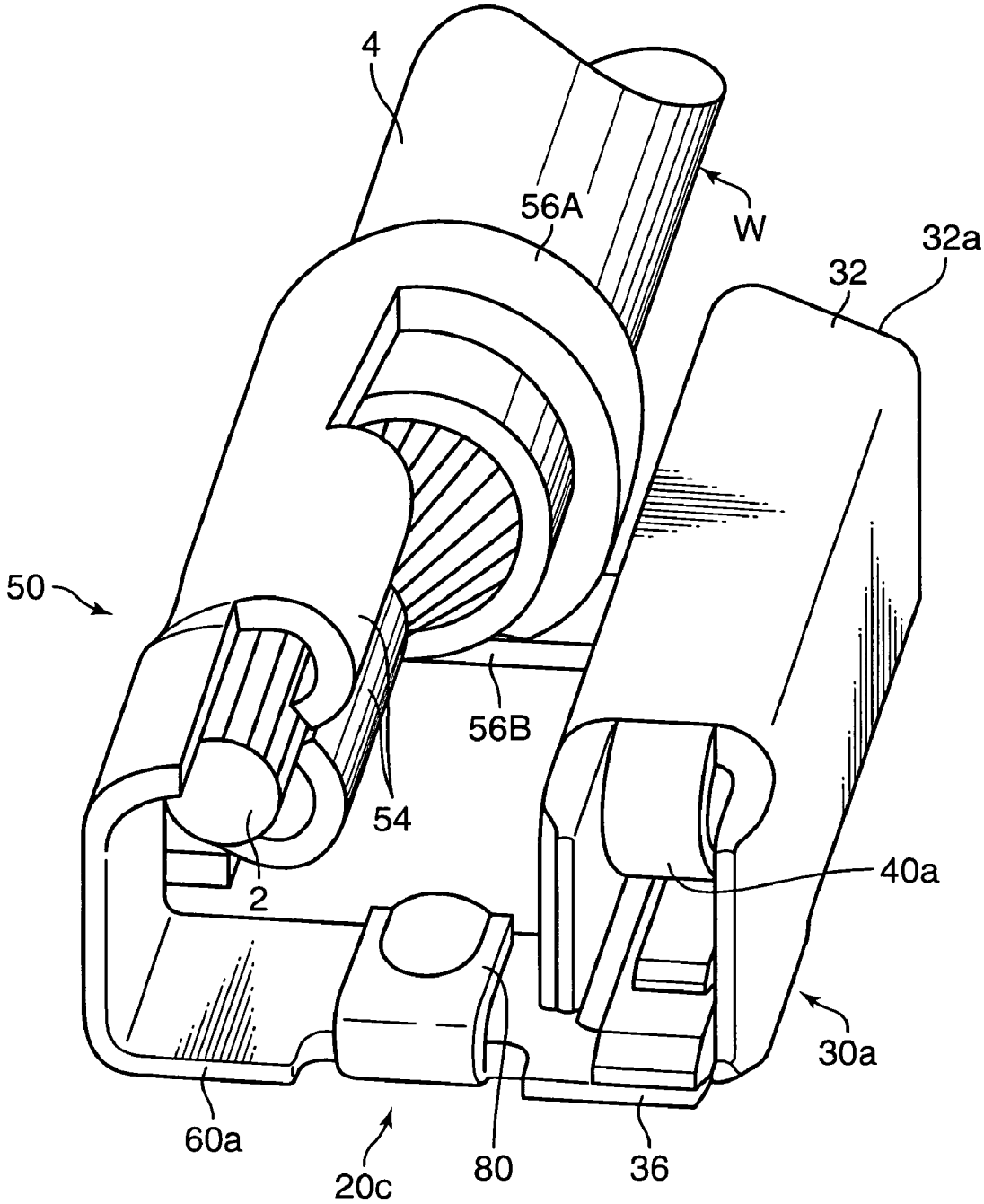
FIG. 33 is a perspective view depicting a connector terminal according to a fourth embodiment of the present invention.

Now a fourth embodiment will be described with reference to FIG. 33 and FIG. 34.

Provided is a connector terminal 20*c* according to the present embodiment, in which insulation barrels constituting a wire connecting portion are utilized to suppress the above-mentioned deformation. Specifically, this connector terminal 20*c*, similarly to the connector terminal 20*a* according to the second embodiment, has a terminal inserting portion 30*a*, a wire connecting portion 50 and coupling portion 60*a* coupling these portions as shown in FIG. 33, the wire connecting portion 50 having a pair of conductor barrels 54 and 54 and a pair of insulation barrels 56A and 56B; however, the insulation barrel 56B on one side is integrally continuous with a rear end portion (an end portion on the opposite side of the coupling portion 60*a*) of the terminal inserting portion 30*a*, as shown in FIG. 34, a development view. The other insulation barrel 56A surrounds the insulation coating 4 of the wire W in most of the circumferential area thereof, and the coupling portion 60*a* is bent at about 90° in a direction of bringing the wire W close to the insulation barrel 56B: the insulation barrels 56A and 56B are thereby crimped to the wire W.

In this way, to protect the terminal inserting portion 30*a*, one insulation barrel 56B out of the pair of insulation barrels 56 is constructed as a coupling portion (second coupling portion if the above mentioned coupling portion 60*a* is called the first coupling portion) connected to the terminal inserting portion 30*a*: this enables not only the front end portion of the terminal inserting portion 30*a* to be intercoupled via the first coupling portion 60*a* but also the rear end portion to be intercoupled via the insulation barrel 56B, i.e. the second coupling portion, thus ensuring a protection of the terminal inserting portion 30*a*.

Such integral continuity of the insulation barrel 56B on one side with the terminal inserting portion 30*a* independently of the coupling portion 60*a* dramatically enhances the rigidity of the entire connector terminal 20*c*, particularly effectively suppressing such deformation as to expand an opening between the wire connecting portion 50 and the terminal inserting portion 30*a*. In addition, this effect is implemented without adding any special reinforcing element, but by a simple structure in which merely the insulation barrel 56B is continuous with the terminal inserting portion 30*a*.

Concerning the fourth embodiment, the coupling portion 60*a* is not required to be bent at a substantially right angle. Also the continuing position of the insulation barrel 56B with the terminal inserting portion 30*a* can be set as considered appropriate.

Figure 34:
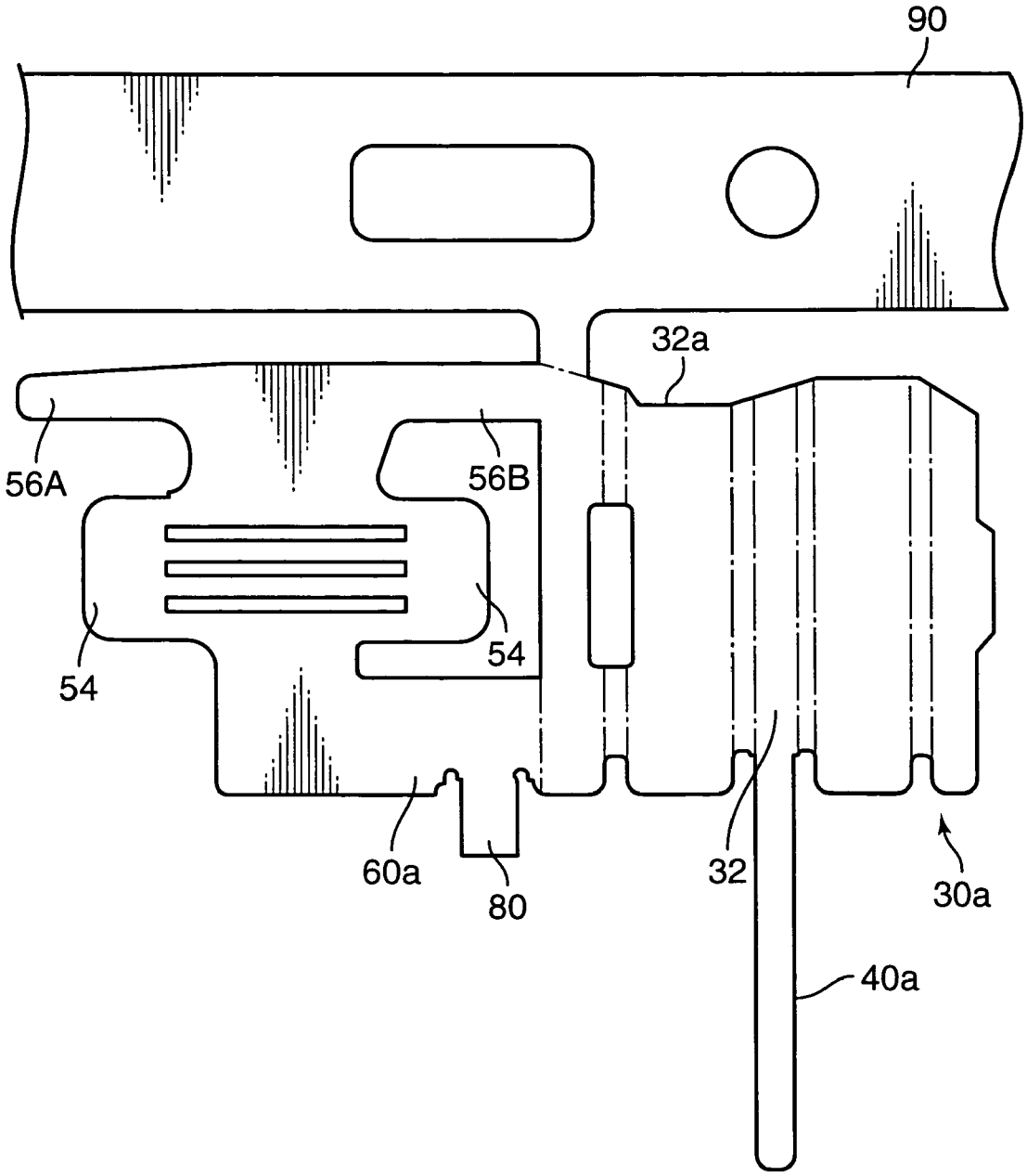
FIG. 34 is a development depicting the connector terminal according to the present embodiment.

As shown in FIG. 34, may be realized another structure for preventing the connector terminal 20 from being hooked with another component, by notching a rear end portion 32*a* of the terminal inserting portion 30*a* to give an inclination to the rear end portion 32*a* of bended connector terminal 20.

The present invention is not limited to the above embodiments, but may assume the following modes.

The coupling portion 60 of the connector terminal 20, though coupling the front end portion of the terminal inserting portion 30 and the front end portion of the wire connecting portion 50 in the first embodiment, may intercouple the center portions or the rear end portions of these portions 30 and 50 mutually, or may intercouple different positions in the central axis direction C (e.g. a tip of one portion and a rear end of the other) mutually. In other words, the coupling portion 60 does not necessarily have to intercouple the terminal inserting portion 30 and the wire connecting portion 50 in a direction perpendicular to the central axis direction C of the terminal inserting portion 30 and the axial center direction X of the wire connecting portion 50; but may intercouple in another direction but crossing the central axis direction C and the axial center direction X.

The coupling portion 60,though formed as one plate-like body having a predetermined width (length in the front and back directions is predetermined) in each of the above embodiments, may be a plate-like body having a non-constant (varied) width. Furthermore, the terminal inserting portion 30 and the wire connecting portion 50 may be intercoupled via a plurality of coupling portions 60, 60, . . . . Moreover, the coupling portion 60 is not limited to a plate-like body, as long as it can make an electrical connection of the terminal inserting portion 30 and the wire connecting portion 50 with a predetermined resistance value or less while being easy to bend, such as a thin rod.

Though the connector 10 according to the first embodiment is provided with the connector terminals 20 so that four of the connector terminals 20 are lined up horizontally in each of top and bottom rows, the present invention is not limited to this acceptable is a housing 70 formed with cavities 72, 72, . . . so as to hold a plurality of connector terminals 20, 20, . . . lined up in a direction perpendicular to the juxtaposing direction of the terminal inserting portion 30 and the wire connecting portion 50 of the connector terminal 20. This formation of the cavities 72, 72, . . . enables the pitch (distance) between the cavities 72 and 72 to be maintained as small as that in a conventional connector. Accordingly, the number of cavities 72 horizontally lining up is allowed to be more or less than four, the number of rows allowed to be one or more than three.

As described above, the present invention provides a connector terminal adapted to be disposed in an end of a coated wire to be connected with a partner terminal. This connector terminal has a terminal inserting portion into which the partner terminal is inserted, a wire connecting portion adapted to be connected to the end of the coated wire, and a coupling portion intercoupling and electrically interconnecting the terminal inserting portion and wire connecting portion. The terminal inserting portion and the wire connecting portion are so juxtaposed as to make an inserting direction in which the partner terminal is inserted into the terminal insertion portion and an axial center direction of the coated wire to be connected to the wire connecting portion parallel or substantially parallel with each other, and as to overlap with each other in a direction perpendicular to or substantially perpendicular to both of the inserting direction of the partner terminal and the axial center direction of the end of the coated wire.

The entire length (overall length) of this connector terminal in a fitting (inserting) direction in which the connector terminal is fitted with the partner terminal is shorter (decreased in length) than that of a conventional connector terminal. Specifically, the terminal inserting portion and the wire connecting portion are so intercoupled as to overlap with each other in a direction perpendicular to or substantially perpendicular to both of the inserting direction of the partner terminal and the axial center direction of the end of the coated wire, thus shortening the connector terminal for the amount of the overlap of the terminal inserting portion and the wire connecting portion, as compared with a conventional connector terminal where the terminal inserting portion and the wire connecting portion are disposed in a series in the inserting direction with the partner terminal, even if the space in the fitting direction is limited. This shortened terminal length facilitates a fitting or separating operation of connectors, even if the space in the fitting direction is limited.

In the present invention, at least a part of the terminal inserting portion, at least a part of the wire connecting portion, and the coupling portion may be constructed by a common plate-like body along a plane including the inserting direction of the partner terminal and the axial center direction of the end of the coated wire. This gives the connector terminal a simple and light weight structure. Accordingly, the number of components and manufacturing steps of the connector terminal are decreased, resulting in a reduced manufacturing cost.

In this case, it is preferable that the coupling portion has a rib positioned midway between the terminal inserting portion and the wire connecting portion. The ribs can enhance a torsional rigidity of the coupling portion between the inserting direction of the partner terminal and the axial center direction of the end of the coated wire in spite that the coupling portion is a plate-like body. This reduces a rate of defect generation due to bending of the coupling portion when the connector terminal is connected to the coated wire or is inserted into the cavity of the connector housing during the manufacturing steps of the connector.

The coupling portion may have a locked portion, positioned midway between the terminal inserting portion and the wire connecting portion, for being locked by a lance formed in an inner surface of the connector housing. The locked portion enables the connector terminal inserted into the connector housing to be positively locked within the connector housing.

The coupling portion may be bent at substantially a right angle in a direction of bringing the terminal inserting portion closer to the wire connecting portion. This can decrease the dimensions in the juxtaposing direction of the terminal inserting portion and the wire connecting portion.

Furthermore, in this case, the terminal inserting portion can be protected by a simple structure. Specifically, it is preferable that the wire connecting portion has: a base wall extending from the coupling portion in parallel with the axis direction of the coated wire; conductor barrels extending from opposite widthwise ends of the base wall and adapted to be crimped to a conductor exposed in an end of the coated-wire; insulation barrels extending from opposite widthwise ends of the base wall at positions more distant from the coupling portion than the conductor barrels and adapted to be crimped to an insulated coating of the coated wire; and a protective portion extending from the base wall at a position more distant from the coupling portion than the insulation barrels, the protective portions having an shape to cover the terminal inserting portion from an opposite side of the coupling portion.

This structure, having the protective portions simply added to the conductor barrels and the insulation barrels, can effectively protect the terminal inserting portion. Specifically, the connector terminal according to the present invention, having an overlap of the terminal inserting portion and the wire connecting portion in a direction perpendicular to or substantially perpendicular to the inserting direction with the partner terminal, tends to be hooked onto another component to be deformed or damaged; however, the protective portion can prevent it by covering the terminal inserting portion from the opposite side of the coupling portion.

In order to prevent deformation and damage of the connector terminal, it is also effective that the wire connecting portion has: a base wall extending from the coupling portion in a direction parallel with the axis direction of the coated wire; conductor barrels extending from opposite widthwise ends of the base wall and adapted to be crimped to a conductor exposed in an end of the coated wire; and insulation barrels extending from opposite widthwise ends of the base wall at positions more distant from the coupling portion than the conductor barrels and adapted to be crimped to an insulated coating of the coated wire, one of the insulation barrels being integrally continuous with the terminal inserting portion independently from the coupling portion. In this structure, the terminal inserting portion and the wire connecting portion are intercoupled via the insulation barrels separate from the coupling portion in addition to the coupling via the coupling portion, which increases a rigidity of the entire connector terminal, effectively suppressing deformation of the terminal.

The present invention also provides a connector having a plurality of the above-mentioned connector terminals and a connector housing holding the connector terminals lined up in a direction perpendicular to the juxtaposing direction of the terminal inserting portion and the wire connecting portion.

According to this connector, a decrease in the overall length of each connector terminal reduces the overall length of the connector housing to hold the connector terminals. Moreover, since the connector housing holds the connector terminals lined up in a direction perpendicular to the juxtaposing direction of the terminal inserting portion and the wire connecting portion, (the distance (pitch) of adjacent connector terminals can be suppressed to be equivalent to the distance between conventional connector terminals where the terminal inserting portion and the wire connecting portion are disposed in a series.

In short, in the connector according to the present invention, the overall length of the connector housing in the fitting direction in which the connector is fitted with the partner connector can be decreased while the distance between the connector terminals are suppressed to be equivalent to conventional connectors. This facilitates operations of fitting and separation of the connector terminal (connector) and the partner terminal (partner connector), even if the space in the fitting direction is limited, without much increasing the size of the connector housing in the direction perpendicular to the fitting direction with the partner connector as compared with conventional connectors.

The invention claimed is:

1. A connector terminal adapted to be disposed in an end of a coated wire to be connected with a partner terminal, comprising:

a terminal inserting portion to which said partner terminal is inserted;

a wire connecting portion adapted to be connected to the end of said coated wire; and a coupling portion intercoupling and electrically interconnecting said terminal inserting portion and said wire connecting portion, wherein:

said terminal inserting portion and said wire connecting portion are juxtaposed so as to make an inserting direction in which the partner terminal is inserted into the terminal inserting portion and an axial center direction of the end of the coated wire to be connected to the wire connecting portion parallel or substantially parallel with each other and overlap with each other in a direction perpendicular to or substantially perpendicular to both the inserting direction of the partner terminal and the axial center direction of the end of the coated wire, at least a part of said terminal inserting portion, at least a part of said wire connecting portion and said coupling portion are constructed by a common plate-like body along a plane including the inserting direction of said partner terminal and the axial center direction of the end of said coated wire, and said coupling portion has a locked portion to be locked by a lance formed on an inner surface of a connector housing, the locked portion positioned midway between said terminal inserting portion and said wire connecting portion.

2. A connector, comprising:

a plurality of connector terminals according to claim 1; and a connector housing to hold said connector terminals such that said connector terminals are lined up in a direction perpendicular to a direction of arrangement of the terminal inserting portion and the wire connecting portion.

3. The connector terminal according to claim 1, wherein said coupling portion has a rib positioned midway between said terminal inserting portion and said wire connecting portion.

4. A connector terminal adapted to be disposed in an end of a coated wire to be connected with a partner terminal, comprising:

a terminal inserting portion to which said partner terminal is inserted;

a wire connecting portion adapted to be connected to the end of said coated wire; and a coupling portion intercoupling and electrically interconnecting said terminal inserting portion and said wire connecting portion, wherein:

said terminal inserting portion and said wire connecting portion are juxtaposed so as to make an inserting direction in which the partner terminal is inserted into the terminal inserting portion and an axial center direction of the end of the coated wire to be connected to the wire connecting portion parallel or substantially parallel with each other and overlap with each other in a direction perpendicular to or substantially perpendicular to both the inserting direction of the partner terminal and the axial center direction of the end of the coated wire;

at least a part of said terminal inserting portion, at least a part of said wire connecting portion and said coupling portion are constructed by a common plate-like body along a plane including the inserting direction of said partner terminal and the axial center direction of the end of said coated wire; and said wire connecting portion comprises:

a base wall extending from said coupling portion in a direction parallel with the axis direction of said coated wire;

a conductor barrel extending from opposite widthwise ends of said base wall respectively and adapted to be crimped to a conductor exposed in the end of said coated wire;

insulation barrels extending from opposite widthwise ends of said base wall at positions more distant from said coupling portion than said conductor barrels and adapted to be crimped to an insulated coating of said coated wire; and a protective portion extending from said base wall at a position more distant from said coupling portion than said insulation barrels and being shaped to cover said terminal inserting portion from a side opposite said coupling portion.

5. A connector, comprising:

a plurality of connector terminals according to claim 4; and a connector housing to hold said connector terminals such that said connector terminals are lined up in a direction perpendicular to a direction of arrangement of the terminal inserting portion and the wire connecting portion.

6. The connector terminal according to claim 4, wherein said coupling portion has a rib positioned midway between said terminal inserting portion and said wire connecting portion.

7. A connector terminal adapted to be disposed in an end of a coated wire to be connected with a partner terminal, comprising:

a terminal inserting portion to which said partner terminal is inserted;

a wire connecting portion adapted to be connected to the end of said coated wire; and a coupling portion intercoupling and electrically interconnecting said terminal inserting portion and said wire connecting portion; wherein:

said terminal inserting portion and said wire connecting portion are juxtaposed so as to make an inserting direction in which the partner terminal is inserted into the terminal inserting portion and an axial center direction of the end of the coated wire to be connected to the wire connecting portion parallel or substantially parallel with each other and overlap with each other in a direction perpendicular to or substantially perpendicular to both the inserting direction of the partner terminal and the axial center direction of the end of the coated wire, at least a part of said terminal inserting portion, at least a part of said wire connecting portion and said coupling portion are constructed by a common plate-like body along a plane including the inserting direction of said partner terminal and the axial center direction of the end of said coated wire, and said coupling portion is bent substantially at a right angle in a direction of bringing said terminal inserting portion closer to said wire connecting portion; and said wire connecting portion comprises:

a base wall extending from said coupling portion in a direction parallel with the axis direction of said coated wire;

conductor barrels extending from both ends of said base wall in the width direction and adapted to be crimped to a conductor exposed in the end of said coated wire; and insulation barrels extending from opposite widthwise ends of said base wall at positions more distant from said coupling portion than said conductor barrels and adapted to be crimped to an insulated coating of said coated wire, one of said insulation barrels being integrally continous with said terminal inserting portion independently from said coupling portion.

8. A connector, comprising:

a plurality of connector terminals according to claim 7; and a connector housing to hold said connector terminals such that said connector terminals are lined up in a direction perpendicular to a direction of arrangement of the terminal inserting portion and the wire connecting portion.

9. The connector terminal according to claim 7, wherein said coupling portion has a rib positioned midway between said terminal inserting portion and said wire connecting portion.

* * * * *